US011713559B2

(12) United States Patent
Nagai et al.

(10) Patent No.: US 11,713,559 B2
(45) Date of Patent: Aug. 1, 2023

(54) HYDRAULIC CONTROL DEVICE FOR WORK MACHINE

(71) Applicant: KOBELCO CONSTRUCTION MACHINERY CO., LTD., Hiroshima (JP)

(72) Inventors: Masaki Nagai, Hiroshima (JP); Koji Ueda, Hiroshima (JP); Yuichiro Fujita, Hiroshima (JP)

(73) Assignee: KOBELCO CONSTRUCTION MACHINERY CO., LTD., Hiroshima (JP)

( * ) Notice: Subject to any disclaimer, the term of this patent is extended or adjusted under 35 U.S.C. 154(b) by 32 days.

(21) Appl. No.: 17/619,656

(22) PCT Filed: Jun. 15, 2020

(86) PCT No.: PCT/JP2020/023430
§ 371 (c)(1),
(2) Date: Dec. 16, 2021

(87) PCT Pub. No.: WO2020/262076
PCT Pub. Date: Dec. 30, 2020

(65) Prior Publication Data

US 2022/0356675 A1 Nov. 10, 2022

(30) Foreign Application Priority Data

Jun. 28, 2019 (JP) ..... 2019-121806

(51) Int. Cl.
*E02F 9/22* (2006.01)
*F15B 11/024* (2006.01)
*F15B 11/17* (2006.01)

(52) U.S. Cl.
CPC ..... *E02F 9/2203* (2013.01); *E02F 9/2292* (2013.01); *F15B 11/024* (2013.01); *F15B 11/17* (2013.01); *F15B 2011/0246* (2013.01)

(58) Field of Classification Search
CPC .... F15B 2211/41581; F15B 2011/0246; F15B 2211/3058; F15B 11/024; E02F 9/2203
See application file for complete search history.

(56) References Cited

U.S. PATENT DOCUMENTS

2006/0265915 A1 11/2006 Toji et al.
2010/0122528 A1* 5/2010 Beschorner ..... F15B 21/14 60/424

(Continued)

FOREIGN PATENT DOCUMENTS

CN 103534419 A 1/2014
CN 103547741 A 1/2014

(Continued)

OTHER PUBLICATIONS

International Search Report dated Aug. 11, 2020 in PCT/JP2020/023430 filed on Jun. 15, 2020, citing document AO therein, 2 pages.

(Continued)

*Primary Examiner* — Abiy Teka
(74) *Attorney, Agent, or Firm* — Oblon, McClelland, Maier & Neustadt, L.L.P.

(57) ABSTRACT

Disclosed is a hydraulic control apparatus including a flow-path selector valve that switches a supply flow path and a flow-path switching control unit that operates the same, a regeneration valve and a regeneration release valve capable of the regenerative operation, and a regeneration control unit that operates the same. The flow-path switching control unit makes the flow-path selector valve form a flow-path providing communication between first and second pumps in a combined operation state. The regeneration control unit judges the propriety of the regenerative operation on the (Continued)

basis of the second pump pressure which is the discharge pressure of the second pump in a single operation state and judges the propriety of the regenerative operation on the basis of whether or not the driving state of the work actuator is within an allowable range corresponding to the target work operation amount in the combined operation state.

4 Claims, 6 Drawing Sheets

(56) References Cited

U.S. PATENT DOCUMENTS

| | | | | |
|---|---|---|---|---|
| 2011/0283693 | A1* | 11/2011 | Ramler | F15B 11/024 60/461 |
| 2016/0002889 | A1* | 1/2016 | Kajita | E02F 9/2246 701/99 |
| 2018/0044890 | A1 | 2/2018 | Hijikata et al. | |
| 2018/0066416 | A1* | 3/2018 | Hijikata | E02F 9/2292 |
| 2018/0238025 | A1 | 8/2018 | Imura et al. | |
| 2019/0106861 | A1 | 4/2019 | Izumi et al. | |

FOREIGN PATENT DOCUMENTS

| | | | | |
|---|---|---|---|---|
| EP | 1726723 | A2 * | 11/2006 | E02F 9/2242 |
| EP | 2 933 505 | A1 | 10/2015 | |
| EP | 3 203 088 | A1 | 8/2017 | |
| EP | 3 305 995 | A1 | 4/2018 | |
| JP | 1-320303 | A | 12/1989 | |
| JP | 10-267007 | A | 10/1998 | |
| JP | 2006-329341 | A | 12/2006 | |
| KR | 10-2009-0070802 | A | 7/2009 | |

OTHER PUBLICATIONS

Extended European Search Report dated May 31, 2022 in European Patent Application No. 20832355.0, citing references AA-AC and AO-AQ therein, 10 pages.

Combined Chinese Office Action and Search Report dated Aug. 5, 2022 in Chinese Patent Application No. 202080042147.0 (with unedited computer generated English translation), citing documents 15 through 17 therein, 15 pages.

* cited by examiner

HYDRAULIC CONTROL DEVICE FOR WORK MACHINE

TECHNICAL FIELD

The present invention relates to a hydraulic control apparatus for controlling the motion of a work machine.

BACKGROUND ART

A conventional hydraulic control apparatus is described, for example, in Patent Documents 1 and 2. The apparatus described in FIG. 1 of Patent document 1 includes a first pump, a second pump, a flow-path selector valve for switching a flow path of hydraulic fluid discharged from the first and second pumps (a straight traveling valve in the document), and a plurality of hydraulic actuators. The plurality of hydraulic actuators include a work actuator for actuating a work attachment, a first traveling motor and a second traveling motor for actuating a traveling body. The plurality of hydraulic actuators are divided into a first group including the first traveling motor and a second group including the second traveling motor.

According to the apparatus, in a single operation state where only one of a traveling operation and a work operation is performed, the flow-path selector valve is switched to a neutral position to form a flow path allowing hydraulic fluid discharged from the first and second hydraulic pumps to be supplied to the hydraulic actuators included in the first and second groups, respectively. On the other hand, in a combined operation state where the traveling operation and the work operation are simultaneously performed, the flow-path selector valve is switched to a straight traveling position to form a flow path allowing hydraulic fluid to be supplied from the first pump to the work actuator while allowing hydraulic fluid to be supplied from the first pump to both the first and second traveling motors, thereby securing the straight traveling ability of the traveling motion caused by the first and second traveling motors.

Furthermore, in order to reduce the sudden decrease in the traveling speed at the time when the flow-path selector valve is shifted from the neutral position to the straight traveling position, the straight traveling position is provided with a communication flow path. The communication flow path provides communication between a pump line connected to the first pump and a pump line connected to the second pump, thereby preventing the flow rate of hydraulic fluid to be supplied to the first and second traveling motors from being suddenly decreased by half when the flow-path selector valve is shifted from the neutral position to the straight traveling position.

In patent document 2 is described an apparatus capable of performing a regeneration operation. The regeneration operation is an operation for merging discharge hydraulic fluid that is hydraulic fluid discharged from the working actuator (that is a hydraulic cylinder in the document) into supply hydraulic fluid that is hydraulic fluid to be supplied to the work actuator to thereby increase the driving speed of the work actuator when the work attachment is in a no-load or light load state (refer to paragraph 0003, etc.).

According to the technique described in Patent Document 2, it is determined, on the basis of pump pressure which is discharge pressure of a pump for supplying hydraulic fluid to the work actuator, whether or not the regeneration operation should be performed (see claim 1, paragraph 0011, and paragraph 0012, etc. of the document). If such a technique was applied to such an apparatus as to be described in Patent Document 1, that is, an apparatus including communication between two pump lines of the first and second pumps through a communication flow path in a combined operation state, it could not be appropriately determined whether or not the regeneration operation for the work actuator should be performed in the combined operation state on the basis of the pump pressure. That is because the communication between the pump lines of the first and second pumps in the apparatus causes the pump pressure to be affected by the drive pressure of the first and second traveling motors.

CITATION LIST

Patent Literature

Patent Document 1: Japanese Unexamined Patent Publication No. Hei 10-267007

Patent Document 2: Japanese Unexamined Patent Publication No. 2006-329341

SUMMARY OF INVENTION

It is an object of the present invention to provide a hydraulic control apparatus that is provided in a work machine capable of performing a traveling motion and a work motion, the hydraulic control apparatus being capable of forming an appropriate flow path in each of a single operation state and a combined operation state and appropriately judging whether or not a regeneration operation should be performed.

Provided is a hydraulic control apparatus to be provided in a work machine that includes a first traveling body and a second traveling body, which are provided on the left and right and capable of performing respective traveling motions, and a work attachment capable of performing a work motion, the hydraulic control apparatus including: a first pump that discharges hydraulic fluid; a second pump that is separately provided from the first pump and discharges hydraulic fluid; a first traveling motor that is driven by supply of hydraulic fluid to make the first traveling body perform the traveling motion; a second traveling motor that is driven by supply of hydraulic fluid to make the second traveling body perform the traveling motion; a work actuator that is driven by supply of hydraulic fluid to make the work attachment perform a target work motion included in the work motion; a flow-path selector valve capable of making a flow-path switching motion for switching a flow path of hydraulic fluid discharged by the first pump and the second pump, the flow-path switching motion being a motion of being shifted between a first position for forming a flow path for allowing hydraulic fluid discharged from the first pump to be supplied to the first traveling motor and allowing hydraulic fluid discharged from the second pump to be supplied to the second traveling motor and the work actuator without being supplied to the first traveling motor and a second position for forming a first flow path for allowing hydraulic fluid discharged from the first pump to be supplied to the work actuator and a second flow path for allowing hydraulic fluid discharged from the second pump to be supplied to the first traveling motor and the second traveling motor and forming a communication flow path providing communication between the first flow path and the second flow path, the communication flow path having an opening area variable by the flow-path switching motion; a regeneration valve provided in a regeneration flow path for merging discharge hydraulic fluid that is discharged from the work actuator making the work actuator perform the target work motion into supply hydraulic fluid that is to be supplied to the work actuator, the regeneration valve being shiftable between an opening state of opening the regeneration flow path and a closing state of blocking the regeneration flow path; a regeneration release valve provided in a return flow path allowing the discharge hydraulic fluid to be returned to a tank without merging into the supply hydraulic fluid, the regeneration release valve being shiftable between an opening state of opening the return flow path and a closing state of blocking the return flow path; a driving state detector that detects a physical quantity which is an index of a driving state of the work actuator and varied with a variation in the load of the work actuator; a flow-path switching control unit that makes the flow-path selector valve perform the flow-path switching motion, the flow-path switching control unit configured to shift the flow-path selector valve to the first position in a single operation state where only one of a target work operation that is an operation for making the work attachment perform the target work motion and a traveling operation that is an operation for making the first traveling motor and the second traveling motor perform the respective traveling motions and configured to shift the flow-path selector valve to the second position in a combined operation state where the target work operation and the traveling operation are simultaneously performed; a regeneration control unit that shifts the regeneration valve and the regeneration release valve between a state where the regeneration valve is shifted to the opening state and the regeneration release valve is shifted to the closing state to thereby perform regeneration operation of allowing the discharge hydraulic fluid to be merged into the supply hydraulic fluid and a state where the regeneration valve is shifted to the closing state and the regeneration release valve is shifted to the opening state to perform a generation release operation of preventing the discharge hydraulic fluid from being merged into the supply hydraulic fluid; and a pump pressure detector that detects a second pump pressure, which is a pressure of hydraulic fluid discharged by the second pump. The regeneration control unit is configured to make the regeneration valve and the regeneration release valve perform the regeneration operation when the second pump pressure detected by the pump pressure detector is less than a preset regeneration allowable pump pressure in the single operation state and configured to make the regeneration valve and the regeneration release valve perform the regeneration release operation when the second pump pressure detected by the pump pressure detector is equal to or greater than the regeneration allowable pump pressure in the single operation state. The regeneration control unit stores an allowable range of the physical quantity detected by the driving state detector, the allowable range being set in correspondence with a target work operation amount which is a magnitude of the target work operation, the regeneration control unit being configured to make the regeneration valve and the regeneration release valve perform the regeneration operation when the physical quantity detected by the driving state detector is within the allowable range corresponding to the target work operation amount in the combined operation state and configured to make the regeneration valve and the regeneration release valve perform the regeneration release operation when the physical quantity detected by the driving state detector is deviated from the allowable range corresponding to the target work operation amount.

DESCRIPTION OF EMBODIMENTS

With reference to FIGS. 1 to 6 will be described an embodiment of the present invention.

Figure 1:
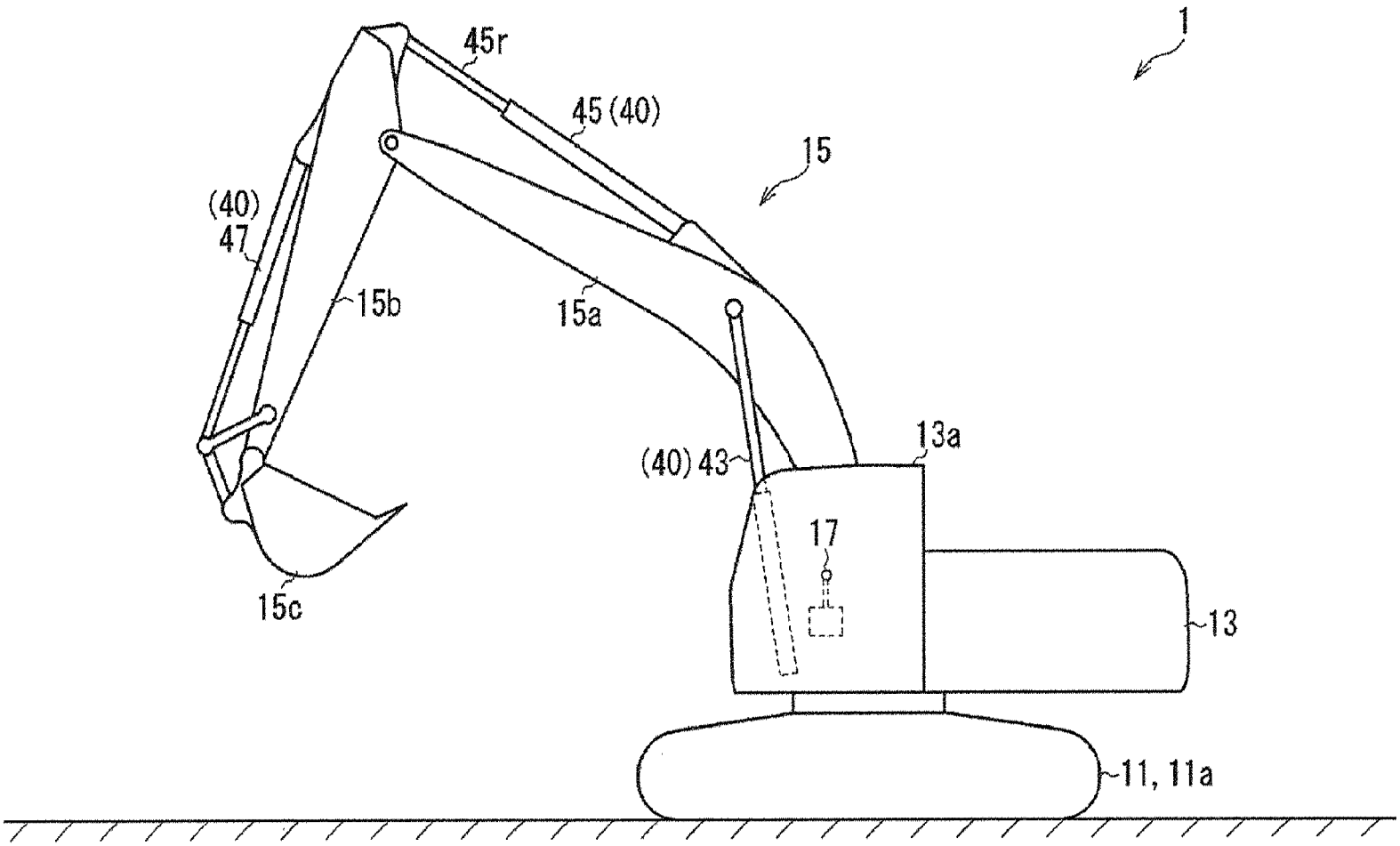
FIG. 1 is a side view of a work machine 1 according to an embodiment of the present invention.

FIG. 1 shows a work machine 1 according to the embodiment. The work machine 1 is a machine for performing work, for example, a construction machine for performing construction work, for example, an excavator. The work machine 1 includes a lower traveling body 11, an upper turning body 13, a work attachment 15, a plurality of operation units 17, and a hydraulic control apparatus 20 shown in FIG. 2.

The lower traveling body 11 includes a pair of crawlers 11*a* that is a first traveling body and a second traveling body provided on the right and left, respectively (FIG. 1 shows only a left crawler HA). Each of the pair of crawlers 11*a* is capable of performing a traveling motion on the ground, which enables the lower traveling body 11 and further the entire work machine 1 including the same to be moved in a traveling direction corresponding to the traveling motion. The upper turning body 13 is mounted on the lower traveling body 11 capably of turning to the lower traveling body 11. The upper turning body 13 includes an operation chamber 13*a*, in which an operation for moving the work machine 1 is performed by an operator.

The work attachment 15 is attached to the upper turning body 13 and performs a work motion that is a motion for the work. The work attachment 15 includes a boom 15*a*, an arm 15*b*, and a bucket 15*c*. The boom 15*a* is attached to the upper turning body 13 capably of vertically rotational motion, namely, derrick motion, relative to the upper turning body 13. The arm 15*b* is attached to the distal end of the boom 15*a* capably of vertically rotational motion, namely, an arm pushing motion and an arm crowding motion, relative to the boom 15*a*. The bucket 15*c* is a part directly contactable with the earth and sand for work such as excavation, transportation and leveling of earth and sand. The bucket 15*c* is attached to the distal end of the arm 15*b* capably of vertically rotational motion relative to the arm 15*b*. The "work motion" performed by the work attachment 15, thus, includes the derrick motion of the boom 15*a*, the rotational motion of the arm 15*b*, and the rotational motion of the bucket 15*c*. In this embodiment, the rotational motion of the arm 15*b* corresponds to the "target work motion".

To the plurality of operation units 17, respective operations for moving the work machine 1 are applied by an operator. The plurality of operation units 17 are disposed, for example, in the operation chamber 13*a*. Each of the operation units 17 includes an operation member to which the operation is applied, for example, a lever (operation lever).

The plurality of operation units 17 include a plurality of work operation units, a first traveling operation unit 171, and a second traveling operation unit 172.

To the plurality of work operation units are applied respective work operations for moving the work attachment 15. The plurality of work operation units include an arm operation unit 17*a* shown in FIG. 2, to which an arm operation is applied, the arm operation being an operation for making the arm 15*b* perform the rotational motion. In addition to the arm operation unit 17*a*, the plurality of work operation units include a boom operation unit to which a boom operation for moving the boom 15*a* is applied and a bucket operation unit to which a bucket operation for moving the bucket 15*c* is applied.

To the first traveling operation unit 171 is applied a first traveling operation that is an operation for making the crawler 11*a* corresponding to the first traveling body out of the pair of crawlers 11*a* of the lower traveling body 11 perform the traveling motion. The first traveling operation is, specifically, an operation for operating the first traveling motor 31 included in the plurality of actuators 28, as will be described later.

To the second traveling operation unit 172 is applied a second traveling operation that is an operation for making the crawler 11*a* corresponding to the second traveling body out of the pair of crawlers 11*a* perform the traveling motion. The second traveling operation is, specifically, an operation for operating the second traveling motor 32 included in the plurality of actuators 28.

There are states of applying operations to the work machine 1, namely, a single operation state where only one of the target work operation and the traveling operation (at least one of the first traveling operation and the second traveling operation) is performed and a combined operation state where the target work operation and the traveling operation are simultaneously performed. The target work operation is an operation for making a target work motion performed, the target motion included in the work operation as described later.

Figure 2:
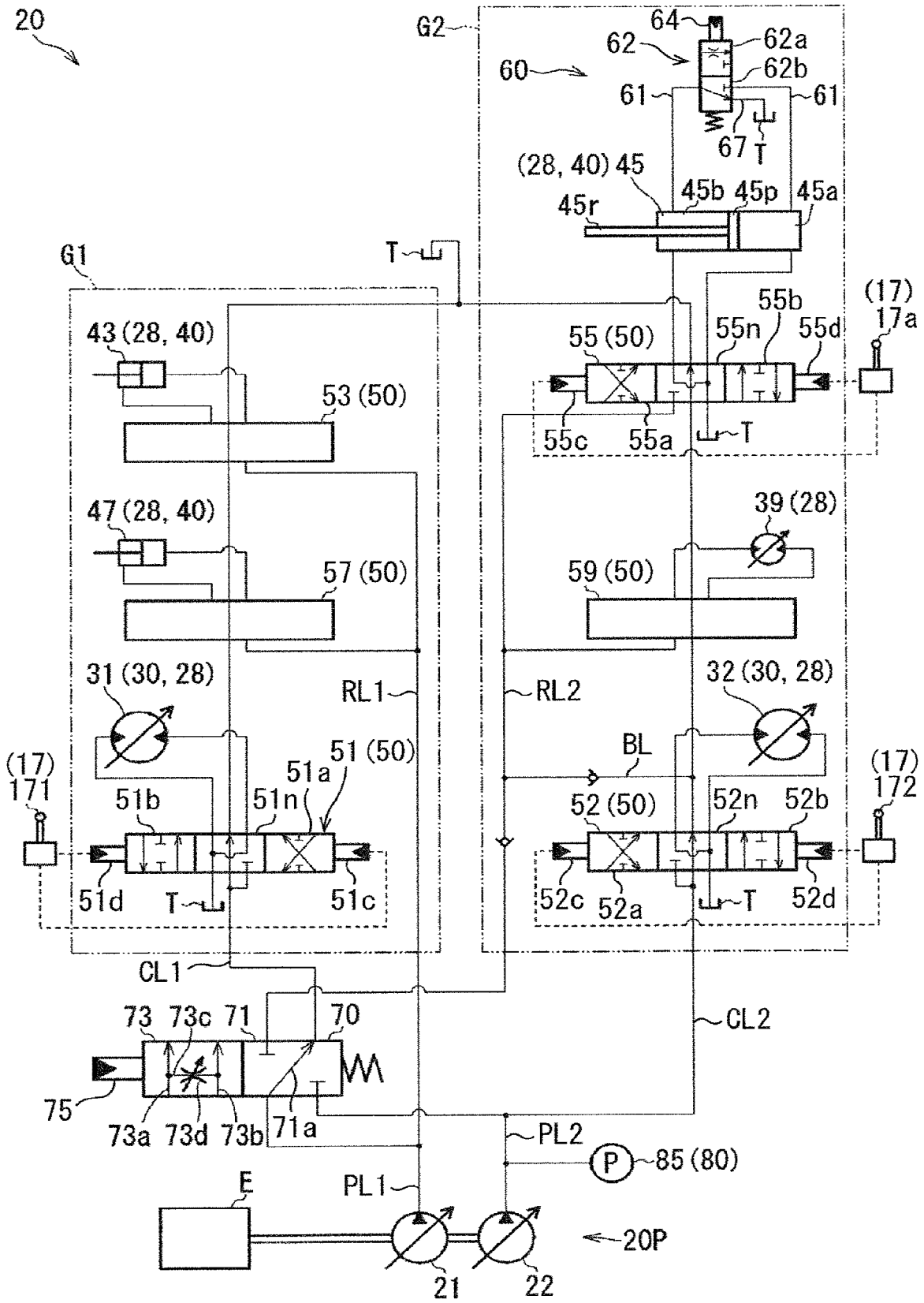
FIG. 2 is a hydraulic circuit diagram showing a hydraulic control apparatus 20 installed on the work machine 1 shown in FIG. 1.
Figure 3:
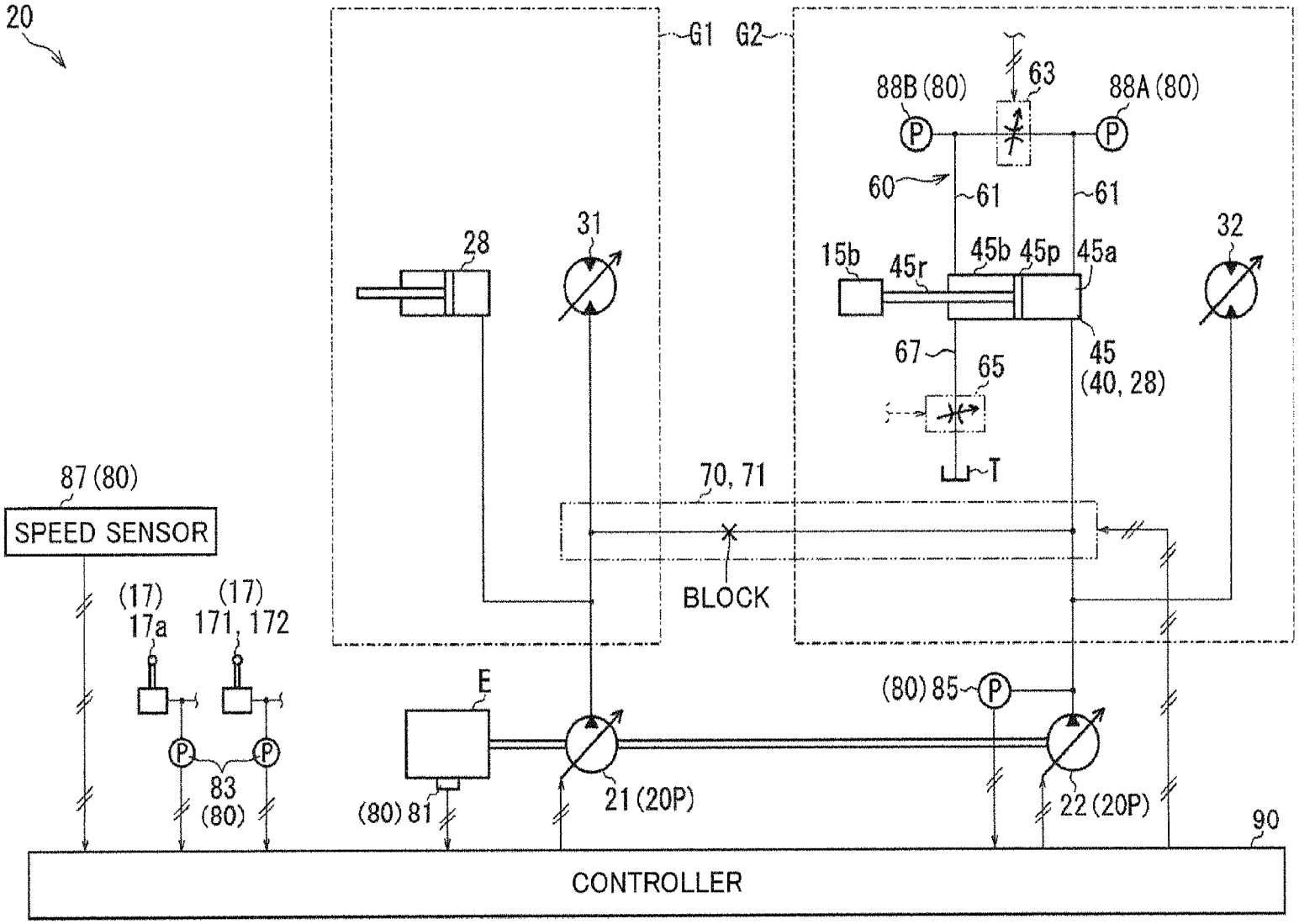
FIG. 3 is a circuit diagram showing a flow path formed by the hydraulic control apparatus 20 in a single operation state.

The hydraulic control apparatus 20 is an apparatus for hydraulically controlling the motion of the work machine 1, being composed mainly of a hydraulic circuit as shown in FIG. 2. The hydraulic control apparatus 20 includes a pump unit 20P, a plurality of actuators 28, a plurality of control valves 50, a regeneration circuit 60, a straight traveling valve 70, a plurality of sensors 80 and a controller 90, as shown in FIG. 3.

The pump unit 20P is a hydraulic source of the hydraulic circuit. The pump unit 20P includes a first hydraulic pump 21 and a second pump 22, each of which is driven by an engine E to discharge hydraulic fluid and supply the hydraulic fluid to each of the plurality of actuators 28.

Each of the plurality of actuators 28 is a hydraulic actuator driven by supply of hydraulic fluid thereto. The plurality of actuators 28 include an expandable hydraulic cylinders and hydraulic motors. Specifically, the plurality of actuators 28 include a first traveling motor 31, a second traveling motor 32, a turning motor 39 and a plurality of work actuators 40.

The first and second traveling motors 31 and 32 are driven so as to make the first and second traveling bodies, namely, the pair of crawlers 11*a* and 11*b* of the lower traveling body 11, perform the traveling motions, respectively. Each of the first and second traveling motors 31 and 32 is a hydraulic motor, specifically, a variable displacement hydraulic motor having a motor capacity variable in accordance with a capacity command input thereto. The first traveling motor 31 makes the first traveling body, specifically, one of the right and left crawlers 11*a*, for example, the right crawler 11*a*, perform the traveling motion. The second traveling motor 32 makes the second traveling body, specifically, the other of the right and left crawlers 11*a*, for example, the left crawler 11*a*, perform the traveling motion.

The turning motor 39 is driven so as to turn the upper turning body 13 relatively to the lower traveling body 11. The turning motor 39 is a hydraulic motor. The turning motor turns the upper turning body 13 relatively to the lower traveling body 11, thereby turning the work attachment 15 relatively to the lower traveling body 11. The turning motor 39 is not included in the plurality of work actuators 40 in this embodiment, but may be included in the plurality of work actuators 40.

Each of the plurality of work actuators 40 is driven so as to make the work attachment 15 perform the work motion. Each of the plurality of work actuators 40 is a hydraulic cylinder. The plurality of work actuators 40 include a boom cylinder 43, an arm cylinder 45, and a bucket cylinder 47, which are shown in FIG. 1.

The boom cylinder 43 is expanded and contracted so as to make the boom 15*a* perform the derricking motion which is the vertically rotational motion. Each of the boom cylinder 43 and the bucket cylinder 47 has a rod chamber and a head chamber, and performs expansion and contraction motions similar to that of the arm cylinder 45 as described below.

The arm cylinder 45 is driven so as to make the arm 15*b* perform vertically rotational motion relative to the boom 15*a*. As shown in FIG. 2, the arm cylinder 45 includes a cylinder body forming a head chamber 45*a* and a rod chamber 45*b*, a piston 45*p*, and a rod 45*r*. The piston 45*p* is loaded in the cylinder body to separate the head chamber 45A and the rod chamber 45B from each other. The arm cylinder 45 is expanded, while discharging of hydraulic fluid from the rod chamber 45*b*, by supply of hydraulic fluid to the head chamber 45*a*. The arm cylinder 45 is contracted, while discharging hydraulic fluid from the head chamber 45*a*, by supply of hydraulic fluid to the rod chamber 45*b*.

The bucket cylinder 47 is driven so as to make the bucket 15*c* perform vertically rotational motion relative to the arm 15*b*.

The "work actuator" according to the present invention is selected from, for example, the arm cylinder 45, the boom cylinder 43, and the bucket cylinder 47.

Besides, the "target work motion" according to the present invention is selected from respective rotational motions performed by a plurality of work attachment elements shown in FIG. 1, namely, the arm 15*b*, the boom 15*a*, and the bucket 15*c*. In this embodiment, the arm rotational motion which is the rotational motion of the arm 15*b* corresponds to the "target work motion", and the arm cylinder 45 corresponds to the "work actuator" according to the present invention.

The plurality of actuators 28 are divided into a first group G1 and a second group G2. The first group G1 includes actuators 28 to be supplied with hydraulic fluid from the first pump 21 in the single operation state, out of the plurality of actuators 28. Specifically, the first group G1 includes the first traveling motor 31 but does not include the arm cylinder 45. The second group G2 includes actuators 28 to be supplied with hydraulic fluid from the second pump 22 in the single operation state, out of the plurality of actuators 28. The second group G2 includes the second traveling motor 32 and the arm cylinder 45.

The turning motor 39, the boom cylinder 43, and the bucket cylinder 47 are included in either the first group G1 or the second group G2. The configuration of the hydraulic circuit may be appropriately modified. In the hydraulic circuit illustrated in FIG. 2, the boom cylinder 43 and the bucket cylinder 47 are included in the first group G1, and the turning motor 39 is included in the second group G2. In the first group G1, the actuators 28 other than the first traveling motor 31, specifically, the boom cylinder 43 and the bucket cylinder 47, are connected to the first hydraulic pump 21 so as to be capable of being always supplied with hydraulic fluid discharged from the first pump 21. The second traveling motor 32 is connected to the second pump 22 so as to be capable of being always supplied with hydraulic fluid discharged from the second pump 22. The hydraulic fluid that fails to be supplied to the second traveling motor 32 out of hydraulic fluid discharged from the second pump 22 can be supplied to the actuators 28 other than the second traveling motor 32 in the second group G2, specifically, the turning motor 39 and the arm cylinder 45.

The plurality of control valves 50 are valves for controlling respective motions of the plurality of actuators 28, respectively. The plurality of control valves 50 are disposed between the pump unit 20P and the plurality of actuators 28, respectively. Each of the plurality of control valves 50 performs opening and closing motion so as to change the direction and the flow rate of hydraulic fluid to be supplied from the pump unit 20P to each of the plurality of actuators 28.

The plurality of control valves 50 include a first traveling control valve 51, a second traveling control valve 52, a boom control valve 53, an arm control valve 55, a bucket control valve 57 and a turning control valve 59.

The first traveling control valve 51 changes the direction and the flow rate of hydraulic fluid to be supplied to the first traveling motor 31 to thereby render the rotational motion of the first traveling motor 31 controllable. The second traveling control valve 52 changes the direction and the flow rate of hydraulic fluid to be supplied to the second traveling motor 32 to thereby render the rotational motion of the second traveling motor 32 controllable. The arm control valve 55, which corresponds to the "work control valve" according to the present invention, changes the direction and the flow rate of hydraulic fluid to be supplied to the arm cylinder 45 to thereby render the expansion and contraction motions of the arm cylinder 45 controllable. The boom control valve 53, the bucket control valve 57, and the turning control valve 59 are respective valves for controlling the rotational motion of the turning motor 39, the expansion and contraction motions of the boom cylinder 43, and the expansion and contraction motions of the bucket cylinder 47. The hydraulic circuit may include a not-graphically-shown bleed valve, which is opened to allow hydraulic fluid that is discharged from the first pump 21 and the second pump 22 but unsupplied to the plurality of actuators 28 to be returned to the tank T.

In the hydraulic circuit illustrated in FIG. 2, the first center bypass line CL1 is selectively connectable to the first pump line PL1 connected to the discharge port of the first pump 21 or the second pump line PL2 connected to the discharge port of the second pump 22, via the straight traveling valve 70. The first traveling control valve 51, the bucket control valve 57, and the boom control valve 53 are respective control valves corresponding to the actuators 28 included in the first group G1, being arranged in this order from the upstream side along the first center bypass line CL1. The first center bypass line CL1 reaches the tank T. Furthermore, a first parallel line RL1 is directly connected to the first pump line PL1 in parallel with the first center bypass line CL1, allowing hydraulic fluid to be supplied in parallel from the first pump 21 to the bucket cylinder 47 and the boom cylinder 43 through the first parallel line RL1 via the bucket control valve 57 and the boom control valve 53, respectively.

The first traveling control valve 51 is shiftable between a neutral position 51*n* for opening the first center bypass line CL1 as it is and an advance drive position 51*a* and a reverse drive position 51*b* for guiding the hydraulic fluid that flows through the first center bypass line CL1 to the advance drive port and the reverse drive port of the first traveling motor 31, respectively. The first traveling control valve 51 has a pair of advance pilot port 51*c* and a reverse pilot port 51*d* disposed at opposite positions to each other, configured to be shifted to the advance drive position 51*a* by input of a pilot pressure to the advance pilot port 51*c* to allow the first traveling motor 31 to be driven in a normal rotational direction (advance drive direction) and configured to be shifted to the reverse drive position 51*b* by input of a pilot pressure to the reverse pilot port 51*d* to allow the first traveling motor 31 to be driven in a reverse rotational direction (reverse drive direction).

To the advance and reverse pilot ports 51*c* and 51*d*, the first traveling operation unit 171 is connected. The first traveling operation unit 171 is operated to input a pilot pressure to the advance pilot port 51*c*, by application of a first traveling operation in an advance operation direction to the operation lever of the first traveling operation unit 171, and operated to input a pilot pressure to the reverse pilot port 51*d*, by application of the first traveling operation in a reverse operation direction to the operation lever.

To the second pump line PL2, a second center bypass line CL2 is directly connected. The second traveling control valve 52, the turning control valve 59, and the arm control valve 55 are control valves included in the second group G2, being arranged in this order from the upstream side along the second center bypass line CL2. The second center bypass line CL2 reaches the tank T. Furthermore, a second parallel line RL2 is disposed in parallel with the second center bypass line CL2, being connectable to the first pump line PL1 via the straight traveling valve 70 to allow hydraulic fluid to be supplied to the turning motor 39 and the arm cylinder 45 from the first pump 21 through the turning control valve 59 and the arm control valve 55, respectively, in parallel through the second parallel line RL2. Besides, a branch line BL is branched from the second center bypass line CL2 at a position downstream of the second traveling control valve 52 and connected to the second parallel line RL2.

The second traveling control valve 52 is shiftable between a neutral position 52*n* for opening the second center bypass line CL2 as it is and an advance drive position 52*a* and a reverse drive position 52*b* for guiding the hydraulic fluid that flows through the second center bypass line CL2 to the advance drive port and the reverse drive port of the second traveling motor 32, respectively. The second traveling control valve 52 has a pair of advance pilot port 52*c* and a reverse pilot port 52*d* disposed at opposite positions to each other, configured to be shifted to the advance drive position 52*a* by input of a pilot pressure to the advance pilot port 52*c* to allow the second traveling motor 32 to be driven in a normal rotational direction (advance direction) and configured to be shifted to the reverse drive position 52*b* by input of a pilot pressure to the reverse pilot port 52*d* to allow the second traveling motor 32 to be driven in a reverse rotational direction (reverse direction).

To the advance and reverse pilot ports 52*c* and 52*d*, the second traveling operation unit 172 is connected. The second traveling operation unit 172 is operated to input a pilot pressure to the advance pilot port 52*c*, by application of a second traveling operation in the advance operation direction to the operation lever of the second traveling operation unit 172, and operated to input a pilot pressure to the reverse pilot port 52*d*, by application of the second traveling operation in the reverse operation direction to the operation lever.

The arm control valve 55 is shiftable between a neutral position 55*n* for opening the second center bypass line CL2 as it is and an arm crowding drive position 55*a* and an arm pushing drive position 55*b* for guiding the hydraulic fluid to be supplied from the first pump 21 through the second parallel line RL2 to the head chamber 45*a* and the rod chamber 45*b* of the arm cylinder 45, respectively. The arm control valve 55 has a pair of arm crowding pilot port 55*c* and arm pushing pilot port 55*d* disposed at opposite positions to each other, configured to be shifted to the arm crowding drive position 55*a* by input of a pilot pressure to the arm crowding pilot port 55*c* to allow the arm cylinder 45 to be driven in the expansion direction (an arm crowding drive direction) and configured to be shifted to the arm pushing drive position 55*b* by input of a pilot pressure to the arm pushing pilot port 55*d* to allow the arm cylinder 45 to be driven in the contraction direction (arm pushing drive direction).

To the arm crowding and arm pushing pilot ports 55*c* and 55*d*, the arm operation unit 17*a* is connected. The arm operation unit 17*a* is operated to input a pilot pressure to the arm crowding pilot port 55*c*, by application of a work operation in an arm crowding operation direction to the operation lever of the arm operation unit 17*a*, and operated to input a pilot pressure to the arm pushing pilot port 55*d*, by application of a work operation in an arm pushing operation direction to the operation lever.

Thus, in this embodiment, the work motion to be the object of the regeneration operation, namely, the target work operation, is the arm crowding motion, and the target work operation for making the target work motion performed is the arm crowding operation. The target work motion and the target work operation corresponding thereto, however, can be arbitrarily selected from the work operation. For example, it is also possible to select the arm pushing motion, the boom rising motion, or the boom falling motion as the target work operation, and to select the arm pushing operation, the boom raising operation, or the boom lowering operation as the target work operation.

The regeneration circuit 60 is a circuit for increasing the driving speed of the arm cylinder 45, more specifically, the speed of the expansion motion for making the arm 15*b* perform the arm crowding motion. The regeneration circuit 60 includes a regeneration flow path 61 and a regeneration selector valve 62.

The regeneration flow path 61 is a flow path providing direct communication between the rod chamber 45*b* and the head chamber 45*a* of the arm cylinder 45, being constituted, for example, by piping.

The regeneration selector valve 62 is provided in the regeneration flow path 61, having both function as a regeneration valve provided in the regeneration flow path 61 and function as a regeneration release valve provided in a return flow path 67 providing communication between the rod chamber 45*b* and the tank T.

The function of the regeneration selector valve 62 as the regeneration valve is a function of being shifted between an opening state (merging allowing state) of opening the regeneration flow path 61 to thereby allow discharge hydraulic fluid, which is hydraulic fluid discharged from the arm cylinder 45 making the arm 15*b* perform the arm crowding motion as the target work motion, i.e., the arm cylinder 45 performing the expansion motion, to be merged into supply hydraulic fluid, which is hydraulic fluid to be supplied to the arm cylinder 45, through the regeneration flow path 61 and a closing state (merging prevention state) of blocking the regeneration flow path 61 to thereby prevent the merging. More specifically, the function is a function of being shifted between a state of allowing discharge hydraulic fluid discharged from the rod chamber 45*b* along with the expansion of the arm cylinder 45 to be merged into supply hydraulic fluid to be supplied to the head chamber 45*a* and a state of preventing the merging. The change in the opening degree of the regeneration selector valve 62 as the regeneration valve, that is, the change in the opening degree of the regeneration flow path 61, may be either selective change between full open and block or continuous change from the full open to the block.

The function of the regeneration selector valve 62 as the regeneration release valve is a function of being shifted between a state of allowing the discharge hydraulic fluid discharged from the arm cylinder 45 to be returned to the tank T through the return flow path 67 and a state of preventing the return. More specifically, the function is a function of being shifted between an opening state (merging release state) of opening the return flow path 67 to thereby allow the discharge hydraulic fluid discharged from the rod chamber 45*b* along with the expansion of the arm cylinder 45 to return to the tank T and a closing state (release prevention state) of blocking the return flow path 67 to thereby prevent or restrain the discharge hydraulic fluid from being returned to the tank T. The change in the opening degree of the regeneration selector valve 62 as the regeneration release valve, that is, the change in the opening degree of the return flow path 67, may be also either selective change between full open and block or continuous change from the full open to the block.

The regeneration selector valve 62 according to this embodiment is composed of a pilot selector valve having a pilot port 64 as shown in FIG. 2, being shiftable between a regeneration allowing position 62A and a regeneration release position 62B. The regeneration selector valve 62 is kept at the regeneration release position 62*b* with input of no pilot pressure to the pilot port 64, thereby blocking the regeneration flow path 61 to prevent the discharge hydraulic fluid from being merged as described above while opening the return flow path 67 to allow the discharge hydraulic fluid to return to the tank T. In contrast, by input of the pilot pressure to the pilot port 64, the regeneration selector valve 62 is shifted from the regeneration release position 62*b* to the regeneration allowing position 62*a* by a stroke corresponding to the magnitude of the pilot pressure, thereby opening the regeneration flow path 61 at the opening degree corresponding to the stroke to allow the discharge hydraulic fluid to be merged into the supply hydraulic fluid at a flow rate (regeneration flow rate) corresponding to the stroke, while blocking or throttling the return flow path 67 to prevent or restrain the discharge hydraulic fluid from being returned to the tank T.

Figure 4:
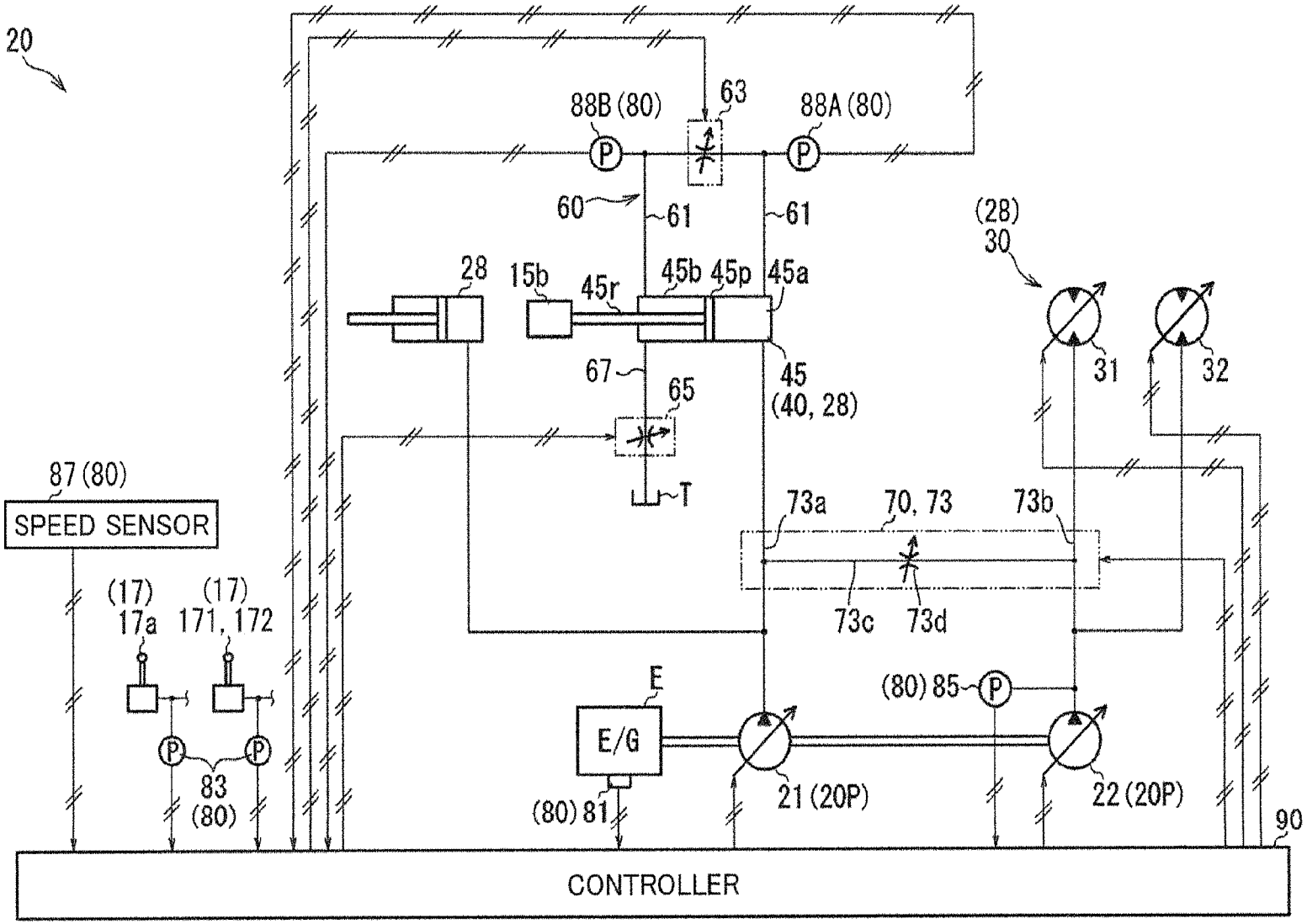
FIG. 4 is a circuit diagram showing a flow path formed by the hydraulic control apparatus 20 in a combined operation state.

The regeneration valve and the regeneration release valve may be composed of separate valves from each other. For example, as schematically shown in FIGS. 3 and 4, it is also possible to dispose a regeneration valve 63 and a regeneration release valve 65 that are separate from each other in the regeneration flow path 61 and in the return flow path 67, respectively. Each of the regeneration valve 63 and the regeneration release valve 65 may be either a variable throttle valve as shown in FIGS. 3 and 4 or a simple selector valve. In FIGS. 3 and 4, where a pilot circuit for selecting regeneration is not graphically shown, a signal that is output from the controller 90 is shown as if being directly input to the regeneration valve 63 and the regeneration release valve 65.

The straight traveling valve 70 is a flow-path selector valve that switches a flow path for supplying hydraulic fluid discharged from each of the first pump 21 and the second pump 22 to the plurality of actuators 28. The straight traveling valve 70 is capable of switching the flow path between a flow path for the single operation state and a flow path for the combined operation state.

Specifically, the straight traveling valve 70 has two switchable positions, namely, a neutral position 71 as a first position and a straight traveling position 73 as a second position. In this embodiment, the straight traveling valve 70 is a hydraulic selector valve having a pilot port 75. The straight traveling valve 70 is kept at the neutral position 71 with input of no pilot pressure to the pilot port 75, but can be shifted from the neutral position 71 to the straight traveling position 73 by input of a pilot pressure to the pilot port 75, by a stroke corresponding to the magnitude of the pilot pressure, that is, being capable of performing a flow-path switching motion. In FIG. 3 and FIG. 4, where a pilot circuit connected to the straight traveling valve 70 is also not graphically shown, a signal that is output from the controller 90 is shown as if being directly input to the straight traveling valve 70, for convenience.

The straight traveling valve 70 forms a flow path for the single operation state at the neutral position 71. The neutral position 71 is selected also when no operation is applied to any of the plurality of operation units 17. As shown in FIGS. 2 and 3, the straight traveling valve 70 blocks the communication between the first pump 21 and the second pump 22 at the neutral position 71, at which the straight traveling valve 70 allows hydraulic fluid discharged from the first pump 21 and the second pump 22 to be supplied to the actuators 28 included in the first group G1 and the actuators 28 included in the second group G2, respectively, and independently of each other. More specifically, when the neutral position 71 is selected, the straight traveling valve 70 forms a flow path 71*a* interconnecting the first pump line PL1 and the first center bypass line CL1 to allow hydraulic fluid discharged from the first pump 21 to be supplied to the actuators 28 included in the first group G1, while blocking both the first center bypass line CL1 and the second parallel line RL2 from the second pump line PL2 to thereby allow hydraulic fluid discharged from the second pump 22 to be supplied only to the actuators 28 included in the second group G2. The straight traveling valve 70, thus, prevents hydraulic fluid discharged from the first pump 21 from being supplied to the actuators 28 included in the second group G2 and prevents hydraulic fluid discharged from the second pump 22 from being supplied to the actuators 28 included in the first group G1, when the neutral position 71 is selected.

At the straight traveling position 73, the straight traveling valve 70 forms a flow path for the combined operation state. The flow path is a flow path for urging the lower traveling body 11 into straight traveling as described later. As shown in FIGS. 2 and 4, when the straight traveling position 73 is selected, the straight traveling valve 70 allows hydraulic fluid discharged from the first pump 21 and the second pump 22 to be supplied to the first and second traveling motors 31 and 32 and the arm cylinder 45 as a work actuator, respectively and independently of each other. When the straight traveling position 73 is selected, the straight traveling valve 70 according to this embodiment allows hydraulic fluid discharged from the first pump 21 to be supplied to the actuators 2S other than the first and second traveling motors 31 and 32. For example, when the straight traveling position 73 is selected, the straight traveling valve 70 allows hydraulic fluid discharged from the first pump 21 to be supplied to the arm cylinder 45. When the straight traveling position 73 is selected, the straight traveling valve 70 allows hydraulic fluid discharged from the second pump 22 to be supplied to the first traveling motor 31 and the second traveling motor 32.

At the straight traveling position 73, the straight traveling valve 70 forms a first flow path 73*a*, a second flow path 73*b*, and a communication flow path 73*c*.

The first flow path 73*a* interconnects the first pump line PL1 and the second parallel line RL2, thereby allowing hydraulic fluid discharged from the first pump 21 to be supplied to the arm cylinder 45 via the arm control valve 55. The first flow path 73*a* according to this embodiment also allows hydraulic fluid discharged from the first pump 21 to be supplied to the turning motor 39 via the turning control valve 59. The second flow path 73*b* interconnects the second pump line PL2 and the first center bypass line CL1, thereby allowing hydraulic fluid discharged from the second pump 22 to be supplied not only to the second traveling motor 32 but also to the first traveling motor 31 via the first traveling control valve 51.

The communication flow path 73*c* provides communication between the first flow path 73*a* and the second flow path 73*b*, thereby restraining the first and second traveling motors 31 and 32 from being suddenly decelerated when the operation state is shifted from the single operation state (single traveling operation state) where only the traveling operation is performed to the combined operation state, that is, when the straight traveling valve 70 is shifted from the neutral position 71 to the straight traveling position 73. The communication flow path 73*c* includes a throttle 73*d* having a variable opening area, which is increased with an increase in the stroke of the flow-path switching motion from the neutral position 71 to the straight traveling position 73 (that is, the increase in the pilot pressure). When the stroke is equal to or less than a fixed stroke, the opening area is 0, so that the first flow path 73*a* and the second flow path 73*b* are blocked from each other.

When the straight traveling position 73 is selected and the opening area of the throttle 73*d* is 0 (i.e., when the communication flow path 73*c* is blocked), the straight traveling valve 70 prevents hydraulic fluid discharged from the first pump 21 from being supplied to any of the first and second traveling motors 31 and 32. The straight traveling valve 70 may be configured to prevent hydraulic fluid discharged from the second pump 22 from being supplied to the actuators 28 other than the first and second traveling motors 31 and 32 when the communication flow path 73*c* is thus blocked.

As shown in FIGS. 3 and 4, the plurality of sensors 80 include an engine speed sensor 81, a plurality of pilot pressure sensors 83, a pump pressure sensor 85, and a speed sensor 87.

The engine speed sensor 81 detects the number of revolutions of the engine E, thereby allowing the number of revolutions of each of the first pump 21 and the second pump 22 to be detected. The engine speed sensor 81, thus, can serve as a pump rotation speed detector that detecting the rotation speed of each of the first and second pumps 21 and 22. The pump rotation speed detector, alternatively, may be a sensor directly detecting the rotation speed of the first pump 21 and the second pump 22.

The plurality of pilot pressure sensors 83 detect respective pilot pressures that are output from the plurality of work operation units including the plurality of work operation units (including the arm operation unit 17*a*) and the first and second traveling operation units 171 and 172, thereby allowing respective operations (including the work operation and the first and second traveling operations) applied to the plurality of operation units 17 to be detected. The plurality of pilot pressure sensors 83, thus, constitute an operation detector that detects the presence or absence of an operation applied to each of the plurality of operation units 17 and the amount of the operation which is the magnitude of the operation. In the case where each of the plurality of operation units 17 is configured to output an electric signal corresponding to the operation applied thereto, the operation detector may be configured to detect the electric signal. The operation detector, alternatively, may be an angle sensor that detects an angle of the tilt of the operation lever, which is tilted with the application of an operation to each of the plurality of operation units 17.

As shown in FIG. 3, the pump pressure sensor 85 detects a discharge pressure which is a pressure of hydraulic fluid discharged from the second pump 22, namely, a second pump pressure which is the pump pressure of the second pump 22. The pump pressure sensor 85 can serve, in the single operation state (the single work operation state) where only the work operation is performed out of the traveling motion and the target work operation, as a work actuator load detector that detects a load applied to the arm cylinder 45.

The speed sensor 87 is a speed detector that detects a target work motion speed which is the speed of a target work motion which is a motion generated by the work actuator, out of the work motions, specifically, an arm rotational motion speed which is the rotational motion speed of the arm 15*b* shown in FIG. 1 in this embodiment. The speed sensor 87 can serve as a driving state detector that detects a physical quantity indicating the driving state of the arm cylinder 45.

The physical quantity detected as an index of the driving state is not limited to the target work motion speed, which is the arm rotational motion speed in this embodiment. The driving state detector is, therefore, not limited to the speed sensor 87. The physical quantity may be, for example, a cylinder thrust (actuator thrust) which is a thrust of the arm cylinder 45 which is a work actuator. The driving state detector, thus, may be a thrust detector that detects the actuator thrust.

The speed detector is not limited to one that detects the speed of the rotational motion of the arm 15*b* relative to the boom 15*a*, such as the speed sensor 87. The speed detector may detect the speed of the expansion and contraction motions of the arm cylinder 45. The speed detector, alternatively, may be constituted by an angle sensor or an acceleration sensor, and an arithmetic device that calculates a velocity based on the angle or acceleration detected by the angle sensor or the acceleration sensor.

Preferably, the thrust detector includes, for example, a head pressure sensor 88A and a rod pressure sensor 88B shown in FIGS. 3 and 4. The head pressure sensor 88A detects the pressure of hydraulic fluid in the head chamber 45*a* of the arm cylinder 45, namely, a head pressure. The rod pressure sensor 88B detects the pressure of hydraulic fluid in the rod chamber 45*b*, namely, a rod pressure. The pressure sensor is, typically, less expensive than the speed sensor. The thrust detector, therefore, can serve as the driving state detector with less expensive configuration than that of the speed detector.

The thrust of the arm cylinder 45 is the difference between a head-side force Fa and a rod-side force Fb. The head-side force Fa is the product of the pressure of hydraulic fluid in the head chamber 45*a*, namely, the head pressure, and the pressure-receiving area of the piston 45*p* to the head chamber 45*a*. The rod-side force Fb is the product of the pressure of hydraulic fluid in the rod chamber 45*b*, namely, the rod pressure, and the pressure receiving area of the piston 45*p* to the rod chamber 45*b*. Hence, the thrust detector can be constituted by the head pressure sensor 88A, the rod pressure sensor 88B, and an arithmetic device for calculating the difference between the head pressure and the rod pressure detected by the head pressure sensor 88A and the rod pressure sensor 88B, respectively. The arithmetic device may be a portion having a function of performing the operation in the controller 90. In other words, the thrust detector may include a portion of the controller 90.

The controller 90 performs taking in signals input thereto, output of command signals, arithmetic operations (judgment, calculation), storage of information and the like. The controller 90 has necessary functions in this embodiment: a flow-path switching command section, a regeneration command section, a pump capacity command section, and a motor capacity command section.

The controller 90 including the flow-path switching command section constitutes a flow-path switching control unit, which makes the straight traveling valve 70 perform the flow-path switching motion, in cooperation with a pilot hydraulic source and a flow-path switching operation valve which are not graphically shown. The pilot hydraulic source generates a pilot pressure to be input to the pilot port 75 of the straight traveling valve 70, for example, a pilot pump that is driven by the engine E. The flow-path switching operation valve is interposed between the pilot hydraulic source and the pilot port 75 to adjust the pilot pressure to be finally input to the pilot port 75. Specifically, the flow-path switching operation valve can be composed of a solenoid valve configured to be opened at an opening degree corresponding to the magnitude of the switching command signal by input of the switching command signal to the flow-path switching operation valve, reducing the pilot pressure output from the pilot hydraulic pressure source to the pilot pressure corresponding to the switching command signal and inputting the reduced pilot pressure to the pilot port 75. The flow-path switching command section of the controller 90 generates a switching command signal corresponding to the state of the work machine 1, and inputs it to the flow-path switching operation valve, thereby operating the straight traveling valve 70. Specifically, performed are the control of the stroke from the neutral position 71*n*, that is, the shift of the position of the straight traveling valve 70, and the control of the opening area (opening degree) of the throttle 73*d*.

The controller 90 including the regeneration command section constitutes a regeneration control unit, which makes the regeneration selector valve 62 perform a regeneration operation and a regeneration release operation, in cooperation with the pilot hydraulic source and the regeneration operation valve. The regeneration control valve is interposed between the pilot hydraulic source and the pilot port 64 of the regeneration selector valve 62 to adjust the pilot pressure to be input to the pilot port 64. Specifically, the regeneration operation valve is composed of a solenoid valve configured to be opened at an opening degree corresponding to the magnitude of the regeneration command signal by input of the regeneration command signal to the regeneration operation valve, reducing the pilot pressure output from the pilot hydraulic source to the pilot pressure corresponding to the regeneration command signal and inputting the reduced pilot pressure to the pilot port 64. The regeneration command section of the controller 90 generates a regeneration command signal corresponding to the state of the work machine 1, and inputs the regeneration command signal to the regeneration operation valve, thereby conducting the control of the stroke of the regeneration selector valve 62 from the regeneration release position 62*b* to the regeneration allowing position 62*a*, that is, switching between the regeneration and the release of the regeneration, and the control of the regeneration flow rate.

The pump capacity command section calculates the flow rate of hydraulic fluid to be discharged from each of the first pump 21 and the second pump 22 in accordance with the operation amount of each of the work operation and the traveling operation, generating a pump capacity command for providing the flow rate and inputting the pump capacity command to each of the first and second pumps 21 and 22. Besides, the motor capacity command section generates the motor capacity command according to the operating state of the work machine and inputs the command to each of the first and second traveling motors 31 and 32.

Below will be described the actions of the hydraulic control apparatus 20 described above. The hydraulic control apparatus 20 makes the following actions in each of the single operation state and the combined operation state.

In the single operation state, the flow-path switching command section of the controller 90 stops the input of the switching command signal to the not-graphically-shown flow-path switching operation valve so as to keep the straight traveling valve 70 at the neutral position 71 shown in FIG. 2, that is, so as to prevent any pilot pressure from being input to the pilot port 75 of the straight traveling valve 70. The straight traveling valve 70 thus kept at the neutral position 71 allows hydraulic fluid discharged from the first pump 21 to be supplied to the actuators 28 included in the first group G1, while preventing hydraulic fluid discharged from the first pump 21 from being supplied to the actuators 28 included in the second group G2. Specifically, hydraulic fluid discharged from the first pump 21 can be directly supplied to the bucket control valve 57 and the boom control valve 53 through the first parallel line RL1, and can be supplied to the first traveling control valve 51 through the flow path 71*a* of the straight traveling valve 70 at the neutral position 71 and the first center bypass line CL1. When an operation is applied to any of the operation units 17 corresponding to the actuators 28 included in the first group G1 in this single operation state, the control valve 50 connected to the operation unit 17 to which the operation is applied is opened to allow hydraulic fluid discharged from the first pump 21 to be supplied to the actuator 28 of the first group G1 corresponding to the opened control valve 50 through the control valve 50.

On the other hand, hydraulic fluid discharged from the second pump 22 become suppliable to the second group G2: hydraulic fluid discharged from the second pump 22 is prevented from being supplied to the actuators 28 included in the first group G1 by the straight traveling valve 70 kept at the neutral position 71, while allowed to be supplied to the actuators 28 included in the second group G2 through the second center bypass line CL2, the branch line BL, and the second parallel line RL2. In this state, when an operation is applied to any of the operation units 17 corresponding to the actuators 28 included in the second group G2, the control valve 50 connected to the operation unit 17 to which the operation is applied is opened to allow hydraulic fluid discharged from the second pump 22 to be supplied to the actuators 28 of the second group G2 corresponding to the opened control valve 50 through the control valve 50. For example, when an operation for expanding the arm cylinder 45 to make the arm 15*b* perform the arm crowding motion which is the rotational motion in a direction to approach the boom 15*a*, namely, the arm crowding operation, is applied to the arm operation unit 17*a*, the arm operation unit 17*a* inputs a pilot pressure to the arm crowding pilot port 55*c* of the arm control valve 55 connected to the arm cylinder 45 to shift the arm control valve 55 to the arm crowding drive position 55*a*. The arm control valve 55 thereby forms a flow path allowing hydraulic fluid discharged from the second pump 22 to be supplied to the head chamber 45*a* of the arm cylinder 45 through the second parallel line RL2, and forms a flow path allowing hydraulic fluid discharged from the rod chamber 45*b* of the arm cylinder 45 to be returned to the tank T. This enables the arm cylinder 45 to expand to make the arm 15*b* shown in FIG. 1 perform the rotational motion in the arm crowding direction.

When the arm cylinder 45 is driven, there can be both a case where the regeneration control unit makes the regeneration circuit 60 perform the regeneration operation (arm regeneration operation) and a case where the regeneration control unit prevents the regeneration circuit 60 from performing the regeneration operation, that is, makes the regeneration circuit 60 perform the regeneration release operation.

The regeneration release operation is an operation in which the regeneration valve blocks the regeneration flow path 61 while the regeneration release valve opens the return flow path 67 (for example, fully opens), that is, in the circuit shown in FIG. 2, an operation in which the regeneration selector valve 62 is kept at the regeneration release position 62*b*. This regeneration release operation is an operation of preventing the discharge hydraulic fluid discharged from the rod chamber 45*b* from being supplied to the head chamber 45*a* of the arm cylinder 45 and allowing the discharge hydraulic fluid to be returned to the tank T.

The regeneration operation is an operation in which the regeneration valve opens the regeneration flow path 61 (fully opens or opens at a predetermined opening degree) while the regeneration release valve 65 fully closes or throttles the return flow path 67, that is, in the circuit shown in FIG. 2, an operation in which the regeneration selector valve 62 is shifted to the regeneration allowing position 62*a*. The regeneration operation allows discharge hydraulic fluid discharged from the rod chamber 45*b* to flow through the regeneration flow path 61 to be supplied to the head chamber 45*a* (that is, merged into supply hydraulic fluid to be supplied to the head chamber 45*a*), thereby increasing the rotational motion speed of the arm 15*b*, specifically, the arm crowding motion speed which is the target work motion speed in this embodiment, as compared with the case of no performance of the regeneration operation. As will be described in more detail below, the regeneration operation involves a reduction in the pressure of the rod chamber 45*b*, that is, the drop in the rod pressure, and further the thrust (driving force) of the arm cylinder 45, as compared with the case of no performance of the regeneration operation.

In the single operation state where only the arm crowding operation which is the target work operation in this embodiment out of the arm crowding operation and the traveling operation is performed, the regeneration command section of the controller 90 judges whether the regeneration circuit 60 should be made perform a regeneration operation or a regeneration release operation on the basis of the load of the arm cylinder 45. For example, the regeneration command section of the controller 90 judges the propriety of the regeneration operation on the basis of the pump pressure detected by the pump pressure sensor 85, which is the discharge pressure of the second pump 22, in the single operation state. Specifically, when the discharge pressure of the second pump 22 detected by the pump pressure sensor 85 is equal to or less than a regeneration allowable pump pressure that is stored in the controller 90, that is, when the load of the arm cylinder 45 is small, the regeneration command section inputs the regeneration command signal to the regeneration operation valve so as to make a pilot pressure be input to the pilot port 64 of the regeneration selector valve 62 to allow the regeneration operation. In contrast, when the pump pressure of the second pump 22 is larger than the regeneration allowable pump pressure, that is, when the load of the arm cylinder 45 is large, the regeneration command section stops the input of the pilot pressure to the pilot port 64 so as to stop the input of the regeneration command signal to the regeneration operation valve to prevent the regeneration operation.

In the combined operation state, the flow-path switching control unit of the hydraulic control apparatus 20 shifts the straight traveling valve 70 to the straight traveling position 73. Specifically, the flow path switching command section of the controller 90 inputs a switching command signal to the switching operation unit to allow a pilot pressure to be input to the pilot port 75 of the straight traveling valve 70. The straight traveling valve 70 thus shifted to the straight traveling position 73 forms the first flow path 73*a* allowing hydraulic fluid discharged from the first pump 21 to be supplied to the arm cylinder 45 through the second parallel line RL2 and the arm control valve 55. This allows hydraulic fluid discharged from the first pump 21 to be supplied to the arm cylinder 45 through the arm control valve 55 at a flow rate corresponding to an arm operation amount which is the magnitude of the arm operation applied to the arm operation unit 17*a* for driving the arm cylinder 45.

The straight traveling valve 70 thus shifted to the straight traveling position 73 forms the second flow path 73*b* to thereby allow hydraulic fluid discharged from the second pump 22 to be supplied not only to the second traveling motor 32 but also to the first traveling motor 31 through the first center bypass line CL1 and the first traveling control valve 51. In this condition, when a traveling operation is applied to at least one of the first and second traveling operation units 171 and 172, the traveling control valve corresponding to the traveling operation unit to which the traveling operation is applied, out of the first and second traveling control valves 51 and 52, is opened to allow hydraulic fluid discharged from the second pump 22 to be supplied to the traveling motor corresponding to the thus opened traveling control valve out of the first and second traveling motors 31 and 32 at a flow rate corresponding to the traveling operation amount which is the magnitude of the traveling operation. The first and second traveling motors 31 and 32 are thus allowed to be driven by hydraulic fluid discharged from the common first pump 21. This enables the first and second traveling motors 31 and 32 to be supplied with hydraulic fluid at respective flow rates equal to each other when respective operation amounts of the first and second traveling operations applied to the first and second traveling operation units 171 and 172 are equal to each other, thereby enabling the first and second traveling motors 31 and 32 to be rotated at respective speeds equal to each other to cause the lower traveling body 11 to travel with high straight traveling ability.

The function of the communication flow path 73*c* formed in the straight traveling valve 70 shifted to the straight traveling position 73 is as follows. When the target work operation (the arm operation in this embodiment) is additionally performed in a single operation state including only the traveling operation, that is, in a single traveling operation state, to thereby shift the operation state to the combined operation state, the flow-path switching control unit including the controller 90 shifts the straight traveling valve 70 from the neutral position 71 to the straight traveling position 73. At this time, without the communication flow path 73*c*, the state would be suddenly shifted from a state where hydraulic fluid discharged from the first pump 21 and the second pump 22 is supplied to the first and second traveling motors 31 and 32 to a state where only hydraulic fluid discharged from the second pump 22 is supplied to the first and second traveling motors 31 and 32. This rapidly reduces the flow rate of hydraulic fluid supplied to the first and second traveling motors 31 and 32 and the rotation speed of each of the first and second traveling motors 31 and 32, which may cause a shock such as shaking of the work machine 1. The communication flow path 73*c* reduces such sudden deceleration in the first and second traveling motors 31 and 32. Specifically, the communication flow path 73*c* allows a part of hydraulic fluid discharged from the first pump 21 to be supplied to the second traveling motor 32 at a degree corresponding to the opening area of the communication flow path 73*c*, thereby enabling the first and second traveling motors 31 and 32 to be restrained from sudden deceleration.

As a mode of the combined operation state, there is a state where the work attachment 15 performs a work motion, for example, leveling the ground with the bucket 15*e*, while the pair of crawlers 11*a* of the lower traveling body 11 perform respective traveling motions (namely, a state where leveling with traveling is performed).

As another mode of the combined operation state, there is a state of making the work attachment 15 preform a pulling-up motion for assisting the movement of the lower traveling body 11 in the traveling direction. For example, in the case where the crawler 11*a* is idly running relatively to the ground to make the traveling of the lower traveling body 11 impossible or difficult, such as the case of a largely inclined upward slope or an upward slope with a slippery surface, pulling up the work machine 1 by the motion of the work attachment 15 (the above-described pulling-up motion) can assist the lower traveling body 11 to move the work machine 1. Specifically, making the arm 15*b* perform the arm crowding motion with the tip of the bucket 15*c* stuck into the ground can assist the first and second traveling motors 31 and 32 to advance the lower traveling body 11. Such a pulling-up motion may further involve a boom rising motion of the boom 15*a*. On the other hand, there can be also a case where it is impossible or difficult to move the work machine 1 even with the pulling-up motion.

The above pulling-up motion causes a larger load to be applied to the alai cylinder 45 than the load applied to the first and second traveling motors 31 and 32. In such situation where the load of the arm cylinder 45 as a work actuator is larger than the load of the first and second traveling motors 31 and 32, opening the communication flow path 73*c* with a large opening area would cause the communication flow path 73*c* to permit hydraulic fluid that should be supplied to the arm cylinder 45 to flow to the first and second traveling motors 31 and 32 through the communication flow path 73*c*. This disables the driving pressure of the arm cylinder 45 (the hydraulic pressure required to drive the arm cylinder 45) from being secured, thereby making it impossible or difficult to drive the arm cylinder 45. On the other hand, the flow of hydraulic fluid into the first and second traveling motors 31 and 32 increases the rotation speed of each of the first and second traveling motors 31 and 32 beyond necessity, thereby increasing the possibility of idly running of the pair of crawlers 11*a* which are the first and second traveling bodies and making it difficult to escape from the idly running state. These matters may hinder the work machine 1 to move, rendering the work machine 1 stuck.

On the other hand, the regeneration control in the arm cylinder 45 involves the following problems. Conventionally, the judgment on whether or not a regeneration operation should be performed on a work actuator, for example, the arm cylinder 45, is made based on a pump pressure (the discharge pressure of the second pump 22 in the embodiment) corresponding to the load of the work actuator. However, when the straight traveling valve 70 is shifted to the straight traveling position 73 to open the communication flow path 73*c* in the combined operation state as in the above embodiment, is opened, the communication flow path 73*c* could permit the discharge pressure of the second pump 22 to be affected by the drive pressure of the first and second traveling motors 31 and 32. For example, the communication flow path 73*c*, when fully opened, renders the lower pressure out of the driving pressure of the arm cylinder 45 and the driving pressure of the first and second traveling motors 31 and 32 substantially equal to the pump pressure of the second pump 22. This permits the discharge pressure of the second pump 22 to be substantially equal to the drive pressure of the first and second traveling motors 31 and 32 in spite of, for example, a large load applied to the arm cylinder 45 during the pulling-up motion. If the propriety of the regeneration operation is judged, in such a state, based on the pump pressure of the second pump 22 as described above, the regeneration operation in the regeneration circuit 60 could fail to be released in spite of a large load applied to the arm cylinder 45. This prevents sufficient thrust from being applied to the arm cylinder 45, making it impossible or difficult to drive the arm cylinder 45, for example, making it more difficult to move the work machine 1 by the pulling-up motion. To solve this problem, the regeneration control unit of the hydraulic control apparatus 20 according to the present embodiment judges the propriety of the regeneration on the basis of the physical quantity indicating the driving state of the arm cylinder 45 which is a work actuator in the combined operation state where the communication flow path 73*c* is opened.

Figure 5:
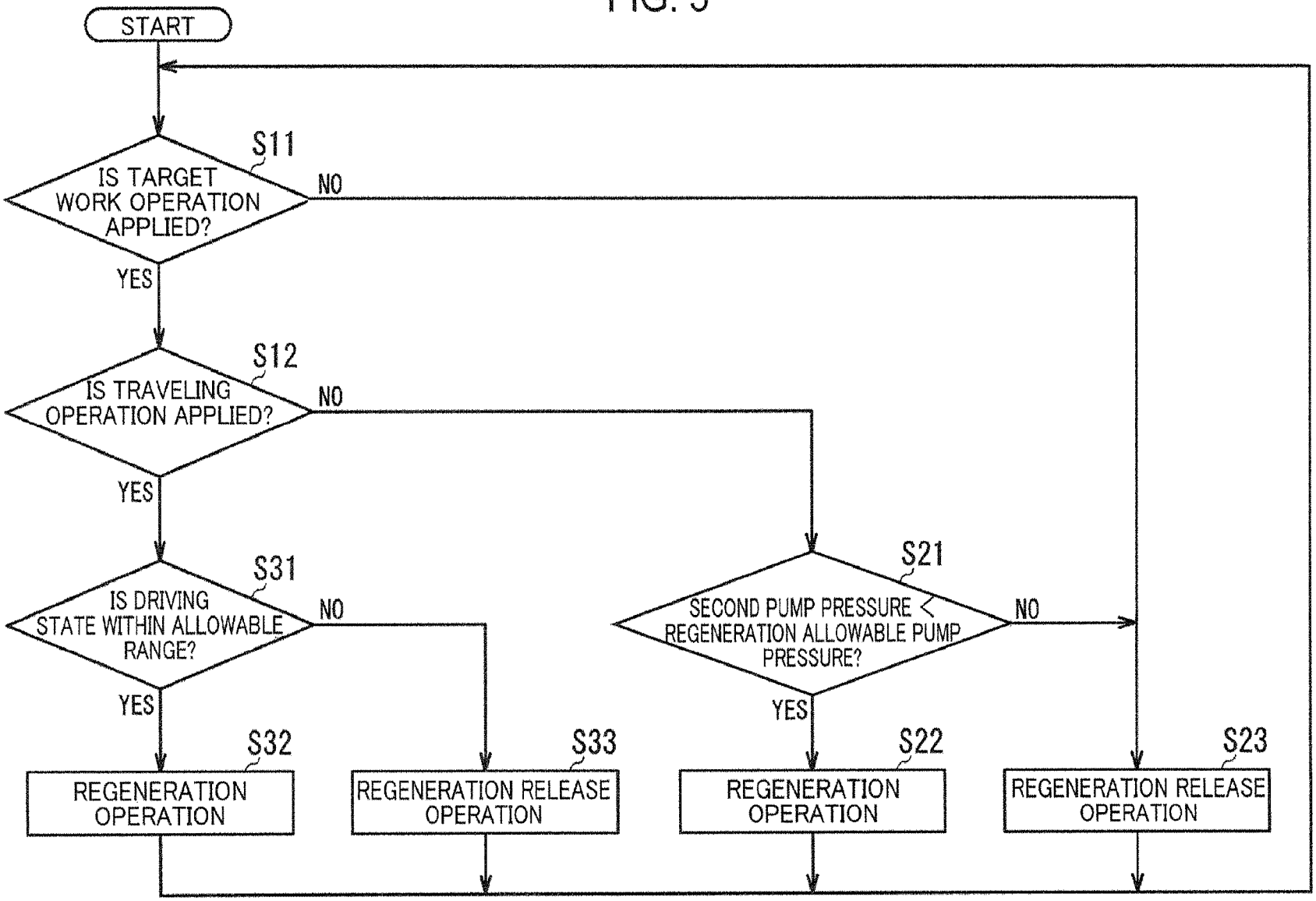
FIG. 5 is a flowchart showing a control operation performed by a controller in the hydraulic control apparatus.

The specific control operation performed by the regeneration control unit will now be described with reference to the flowchart of FIG. 5.

First, the regeneration command section of the controller 90 judges whether or not a target work operation (an arm crowding operation in this embodiment) which is a work operation for making the target work motion, which is the target of the regeneration control, performed is applied to the arm operation unit 17*a* (step S11). When the target work operation (the arm crowding operation) is not applied, the target work motion (the arm crowding motion) is not performed, which involves no necessity of regeneration operation; therefore, the regeneration control unit including the regeneration command section makes the regeneration selector valve 62 perform the regeneration release operation (step S23). Specifically, the regeneration command section according to this embodiment stops the input of the regeneration command signal to the regeneration operation valve to stop the input of a pilot pressure to the regeneration selector valve 62, thereby keeping the regeneration selector valve 62 at the regeneration release position 62*b*. This is an operation in which the regeneration valve included in the regeneration selector valve 62 is shifted to the closing state of blocking the regeneration flow path 61 and the regeneration release valve is shifted to the opening state of opening the return flow path 67.

When the arm crowding operation, which is the target work operation, is applied to the arm operation unit 17*a* (YES in step S11), the flow path switching command section of the controller 90 judges whether or not a traveling operation is applied to at least one of the first and second traveling operation units 171 and 172 (step S12).

When no traveling operation is applied to any of the first and second traveling operation units 171 and 172, that is, when only the target work operation out of the target work operation and the traveling operation is performed (in the single work operation state; NO in step S12), the regeneration command section of the controller 90 judges the propriety of the regeneration operation on the basis of the discharge pressure of the second pump 22 (second pump pressure) detected by the pump pressure sensor 85 (step S21). Specifically, the controller 90 stores a regeneration allowable pump pressure preset for the second pump pressure, and, only when the pump pressure of the second pump 22 actually detected is less than the regeneration allowable pump pressure (YES in step S21), that is, only when the load of the arm cylinder 45 as a work actuator is small, the regeneration control unit including the controller 90 makes the regeneration circuit 60 perform the regeneration operation (step S22). Specifically, the regeneration command section of the controller 90 inputs a regeneration command signal to the regeneration operation valve to allow an pilot pressure to be input to the regeneration selector valve 62, thereby shifting the regeneration selector valve 62 to the regeneration allowing position 62*a*. This is an operation in which the regeneration valve included in the regeneration selector valve 62 is shifted to the closing state of blocking the regeneration flow path 61 and the regeneration release valve is shifted to the opening state of opening the return flow path 67.

When the discharge pressure (pump pressure) of the second pump 22 is equal to or greater than the allowable pump pressure value (NO in step S21), that is, when the load of the arm cylinder 45 is large, the regeneration control unit including the regeneration command section of the controller 90 causes the regeneration circuit 60 to perform the regeneration release operation (step S23).

When the work machine 1 is in the combined operation state (YES in each of step S11 and step S12), the regeneration control unit including the regeneration command section of the controller 90 judges the propriety of the performance of the regeneration operation on the basis of whether or not the driving state of the arm cylinder 45 is within an allowable range, specifically, whether or not the physical quantity that is the index of the driving state variable in response to the change in the load of the arm cylinder 45 is within a preset allowable range (step S31). If the driving state of the arm cylinder 45 is within the allowable range (YES in step S31), the regeneration control unit makes the regeneration circuit 60 perform the regeneration operation (step S32). The allowable range of the physical quantity is set, for example, so that the driving state of the arm cylinder 45 is judged to be within the allowable range to cause the regeneration operation to be performed in the case where the load applied to the arm cylinder 45 is low even in the combined operation state, such as a case where the work machine 1 (see FIG. 1) performs leveling while traveling. The regeneration operation increases the driving speed of the arm cylinder 45 to thereby enable the workability of the work machine 1 to be enhanced. On the other hand, when the driving state of the arm cylinder 45 is deviated from the allowable range (NO in step S31), the regeneration control unit makes the regeneration circuit 60 perform the regeneration release operation (step S33). The allowable range of the physical quantity is set, for example, so that the driving state of the arm cylinder 45 is judged to be deviated from the allowable range to cause the regeneration release operation to be performed in the case where the load applied to the arm cylinder 45 is large in the combined operation state. The regeneration release operation can prevent the thrust of the arm cylinder 45 from being decreased by the execution of the regeneration operation, thereby, for example, enabling the work machine 1 to be easily moved by the pulling-up motion.

The judgment on the propriety of the driving state of the arm cylinder 45 and the setting of the allowable range of the physical quantity for the judgment are based on the following concept. The driving state of the arm cylinder 45 is within the allowable range when the arm cylinder 45 is driven by a speed or thrust substantially corresponding to an arm operation (a target work operation) applied to the arm operation unit 17*a*. The allowable range is set, therefore, such that the arm rotational motion speed (that may be the expansion/contraction speed of the arm cylinder 45) or the cylinder thrust as the index of the driving state at this time is within the allowable range. In contrast, the driving state of the arm cylinder 45 is deviated from the allowable range when the arm rotational motion speed (the expansion/contraction speed) or the thrust does not correspond to the arm crowding operation. For example, the driving state of the arm cylinder 45 is deviated from the allowable range when the arm cylinder 45 is stopped (i.e., the expansion/contraction speed is 0) in spite that an arm operation having a predetermined magnitude or more is applied to the arm operation unit 17*a*. Alternatively, the driving state of the arm cylinder 45 is deviated from the allowable range also when a large thrust is generated in the arm cylinder 45 in spite of a small arm operation.

The allowable range stored in the controller 90 is changed in accordance with the arm operation amount (target work operation amount) which is the magnitude of the arm operation. In summary, the controller 90 stores the allowable range corresponding to the arm operation amount (work operation amount).

Figure 6:
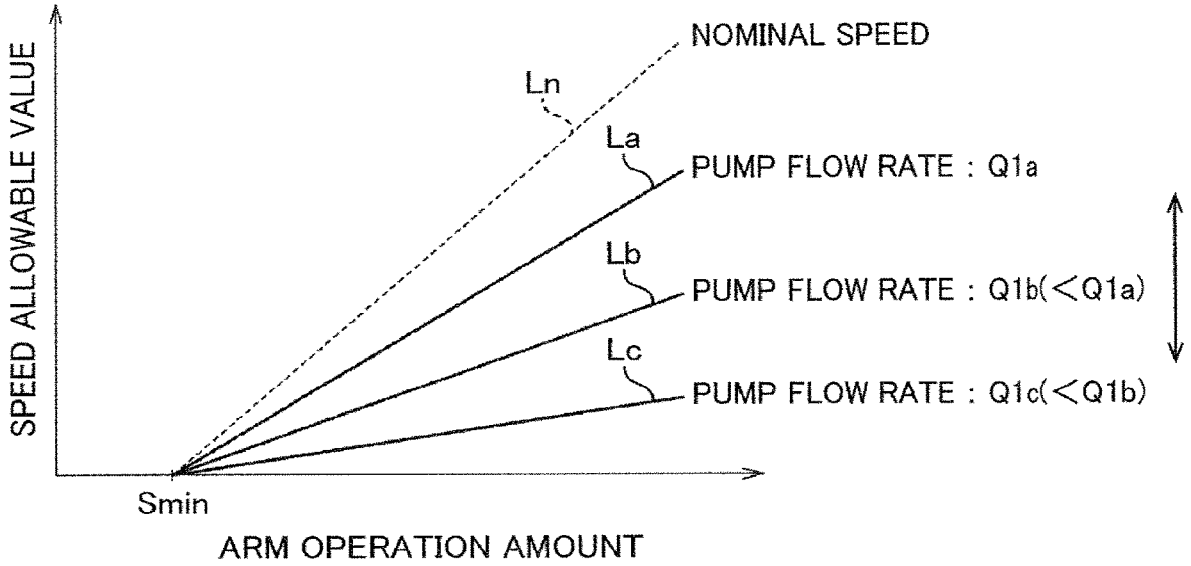
FIG. 6 is a view showing a speed allowable value that is set for the arm rotational motion speed of the work machine 1.

The detail of the case where the physical quantity as the index of the driving state of the arm cylinder 45 is the arm rotational motion speed (or the expansion/contraction speed of the arm cylinder 45), that is, the case where the driving state detector is a speed detector, is as follows. The controller 90 judges whether the speed detected by the speed detector (e.g., the rotational motion speed of the arm 15*b*) is equal to or greater than a speed allowable value set for the speed. The range equal to or more than the speed allowable value is the allowable range of the arm rotational motion speed. The controller 90 stores a map that relates the speed allowable value to the target work operation amount (the arm operation amount in this embodiment) as shown in FIG. 6. According to the map, in the range of the minimum operation amount Smin or more, the smaller the arm operation amount (the target work operation amount) the smaller speed allowable value is set; in the range where the arm operation amount is less than the minimum operation amount Smin (in the range where substantially no arm operation is performed), the speed allowable value is set to 0.

Even for the same arm operation amount (target work operation amount), the expansion speed of the arm cylinder 45 and the rotational motion speed of the arm 15*b* become smaller as the first pump flow rate, which is the flow rate of hydraulic fluid discharged from the first pump 21, is smaller. For this reason, in the map stored in the controller 90, the speed allowable value is set so that the speed allowable value is changed in accordance with the discharge flow rate of the first pump 21, namely, a first pump flow rate (see FIG. 6). Specifically, according to the map, the smaller the first pump flow rate, the lower value is set as the speed allowable value corresponding to the arm operation amount. The first pump flow rate (the volume of hydraulic fluid discharged from the first pump 21 per unit time) is calculated based on the product of the number of revolutions of the engine E (the number of revolutions per unit time) and the capacity of the first pump 21, which allows the flow-path switching command section of the controller 90 to be either configured to set a lower speed allowable value as the number of revolutions of the engine E detected by the engine speed sensor 81 is lower or configured to set a lower speed allowable value as the capacity of the first pump 21 is smaller. FIG. 6 shows a broken line Ln that indicates a nominal speed, which is the rotational motion speed of the arm 15*b* corresponding to the arm operation amount when no load is applied to the arm 15*b*. FIG. 6 shows also solid lines La, Lb and Lc that indicate the speed allowable values corresponding to respective arm operation amounts when the first pump flow rate is Q1*a*, Q1*b* and Q1*c* (Q1*a*>Q1*b*>G1*c*), respectively.

The detail of the case where the detection target physical quantity that indicates the driving state of the arm cylinder 45 is the cylinder thrust of the arm cylinder 45 (actuator thrust), that is, the case where the driving state detector is a thrust detector, is as follows. The controller 90 judges whether the thrust of the arm cylinder 45 detected by the thrust detector (for example, the thrust calculated from the head pressure and the rod pressure detected by the head pressure sensor 88A and the rod pressure sensor 88B, respectively) is equal to or less than a thrust allowable value preset for the thrust. The controller 90 stores a map that relates the thrust allowable value to the target work operation amount (the arm operation amount in this embodiment). The range equal or below the thrust allowable value is the allowable range of the thrust of the arm cylinder 45. The map is, for example, provided by modifying the map shown in FIG. 6 with replacement of the "speed allowable value" with a "thrust allowable value" and replacement of the "nominal speed" with "nominal thrust".

The reason why the propriety of the driving state of the arm cylinder 45 can be judged based on the thrust of the arm cylinder 45 is as follows. When the driving state of the arm cylinder 45 is deviated from the allowable range, for example, when the load applied to the arm 15*b* is so excessive as to restrain or hinder the arm 15*b* and the arm cylinder 45 for driving the arm 15*b* from movement, the piston 45*p* is prevented or remarkably restrained from being moved in the expansion direction by supply of hydraulic fluid to the head chamber 45*a*, because the reaction force transmitted to the piston 45*p* through the rod 45*r* of the arm cylinder 45 is large. This increases the pressure in the head chamber 45*a* as compared with the case where the load is enough small to allow the arm 15*b* to perform a rotational motion corresponding to the arm operation, that is, the case where the driving state of the arm cylinder 45 is within the allowable range. On the other hand, the pressure in the rod chamber 45*b* is, for example, substantially equal to the pressure in the tank T. Hence, the differential pressure between the head pressure and the rod pressure and the thrust of the arm cylinder 45 corresponding thereto when the driving state of the arm cylinder 45 is deviated from the allowable range is larger than that when the driving state is within the allowable range. This is the reason why the propriety of the driving state can be judged on the basis of the thrust of the arm cylinder 45. Accordingly, the flow-path switching command section of the controller 90 may judge the propriety of the driving state directly on the basis of the difference between the head pressure and the rod pressure.

Even when the communication flow path 73*c* permits the hydraulic fluid that should be supplied to the arm cylinder 45 to be supplied to the first traveling motor 31 through the communication flow path 73*c* as described above, the thrust of the arm cylinder 45 becomes higher when the arm 15*b* is not allowed to perform the rotational motion corresponding to the arm operation (that is, when the driving state of the arm cylinder 45 is deviated from the allowable range) than that in the case where the load is enough low to allow the arm 15*b* to perform the rotational motion corresponding to the arm operation (that is, when the driving state of the arm cylinder 45 is within the allowable range). The propriety of the driving state of the arm cylinder 45, therefore, can be judged based on the thrust of the arm cylinder 45.

The above embodiments may be variously modified. For example, the connection of the circuit shown in FIGS. 2, 3 and 4 may be modified. For example, the order of the steps of the flowchart shown in FIG. 5 may be changed, and a part of the steps is omittable. For example, the allowable values, ranges, and the like may be constant, may be changed by manual operation, and may be automatically changed in accordance with some conditions. For example, the number of components may be changed and some of the components may not be provided. For example, what has been described as a plurality of members or portions that are different from each other may be configured to be one member or a portion. For example, what has been described as one member or portion may be divided into a plurality of members or parts that are different from each other.

For example, while the speed allowable value in the embodiment is changed on the basis of both the target work operation amount and the pump flow rate in the embodiment, it may either be changed on the basis of only the target work operation amount or be constant (fixed value). The speed allowable value only has to be a value that renders it judgeable whether or not the target work motion of the work attachment corresponds to the target work operation. The thrust allowable value also may be variously changed within a range satisfying similar conditions.

The position of the regeneration selector valve 62 or the position of each of the regeneration valve 63 and the regeneration release valve 65 is not limited to the positions shown in FIGS. 2 to 4. For example, the position may be set so as to locate the arm control valve 55 in the middle of a flow path between the regeneration selector valve 62 or the pair of the regeneration valve 63 and the regeneration release valve 65 and the arm cylinder 45.

As described above, there is provided a hydraulic control apparatus that is provided in a work machine capable of performing a traveling motion and a work motion, the hydraulic control apparatus being capable of forming an appropriate flow path in each of a single operation state and a combined operation state and appropriately judging whether or not a regeneration operation should be performed.

Provided is a hydraulic control apparatus to be provided in a work machine that includes a first traveling body and a second traveling body, which are provided on the left and right and capable of performing respective traveling motions, and a work attachment capable of performing a work motion, the hydraulic control apparatus including: a first pump that discharges hydraulic fluid; a second pump that is separately provided from the first pump and discharges hydraulic fluid; a first traveling motor that is driven by supply of hydraulic fluid to make the first traveling body perform the traveling motion; a second traveling motor that is driven by supply of hydraulic fluid to make the second traveling body perform the traveling motion; a work actuator that is driven by supply of hydraulic fluid to make the work attachment perform a target work motion included in the work motion; a flow-path selector valve capable of making a flow-path switching motion for switching a flow path of hydraulic fluid discharged by the first pump and the second pump, the flow-path switching motion being a motion of being shifted between a first position for forming a flow path for allowing hydraulic fluid discharged from the first pump to be supplied to the first traveling motor and allowing hydraulic fluid discharged from the second pump to be supplied to the second traveling motor and the work actuator without being supplied to the first traveling motor and a second position for forming a first flow path for allowing hydraulic fluid discharged from the first pump to be supplied to the work actuator and a second flow path for allowing hydraulic fluid discharged from the second pump to be supplied to the first traveling motor and the second traveling motor and forming a communication flow path providing communication between the first flow path and the second flow path, the communication flow path having an opening area variable by the flow-path switching motion; a regeneration valve provided in a regeneration flow path for merging discharge hydraulic fluid that is discharged from the work actuator making the work actuator perform the target work motion into supply hydraulic fluid that is to be supplied to the work actuator, the regeneration valve being shiftable between an opening state of opening the regeneration flow path and a closing state of blocking the regeneration flow path; a regeneration release valve provided in a return flow path allowing the discharge hydraulic fluid to be returned to a tank without merging into the supply hydraulic fluid, the regeneration release valve being shiftable between an opening state of opening the return flow path and a closing state of blocking the return flow path; a driving state detector that detects a physical quantity which is an index of a driving state of the work actuator and varied with a variation in the load of the work actuator; a flow-path switching control unit that makes the flow-path selector valve perform the flow-path switching motion, the flow-path switching control unit configured to shift the flow-path selector valve to the first position in a single operation state where only one of a target work operation that is an operation for making the work attachment perform the target work motion and a traveling operation that is an operation for making the first traveling motor and the second traveling motor perform the respective traveling motions and configured to shift the flow-path selector valve to the second position in a combined operation state where the target work operation and the traveling operation are simultaneously performed; a regeneration control unit that shifts the regeneration valve and the regeneration release valve between a state where the regeneration valve is shifted to the opening state and the regeneration release valve is shifted to the closing state to thereby perform regeneration operation of allowing the discharge hydraulic fluid to be merged into the supply hydraulic fluid and a state where the regeneration valve is shifted to the closing state and the regeneration release valve is shifted to the opening state to perform a generation release operation of preventing the discharge hydraulic fluid from being merged into the supply hydraulic fluid; and a pump pressure detector that detects a second pump pressure, which is a pressure of hydraulic fluid discharged by the second pump. The regeneration control unit is configured to make the regeneration valve and the regeneration release valve perform the regeneration operation when the second pump pressure detected by the pump pressure detector is less than a preset regeneration allowable pump pressure in the single operation state and configured to make the regeneration valve and the regeneration release valve perform the regeneration release operation when the second pump pressure detected by the pump pressure detector is equal to or greater than the regeneration allowable pump pressure in the single operation state. The regeneration control unit stores an allowable range of the physical quantity detected by the driving state detector, the allowable range being set in correspondence with a target work operation amount which is a magnitude of the target work operation, the regeneration control unit being configured to make the regeneration valve and the regeneration release valve perform the regeneration operation when the physical quantity detected by the driving state detector is within the allowable range corresponding to the target work operation amount in the combined operation state and configured to make the regeneration valve and the regeneration release valve perform the regeneration release operation when the physical quantity detected by the driving state detector is deviated from the allowable range corresponding to the target work operation amount.

The flow-path switching control unit of the hydraulic control apparatus can form an appropriate flow path in each of a single operation state and a combined operation state, and the regeneration control unit can make appropriate judgment on whether or not the regeneration operation should be performed in accordance with the flow path to be formed. Specifically, in the single operation state, the flow-path switching control unit shifts the flow path selector valve to the first position so as to form a flow path allowing hydraulic fluid discharged from the first and second pumps to be individually supplied to the first and second traveling motors, respectively, while the regeneration control unit can appropriately judge the propriety of the regeneration operation based on the load applied to the work actuator to which hydraulic fluid is supplied from the second pump, on the basis of the second pump pressure detected by the pump pressure detector, that is, the discharge pressure of the second pump 22. On the other hand, in the combined operation state, the flow-path switching control unit shifts the flow path selector valve to the second position so as to allow both of hydraulic fluid discharged from the first and second pumps to be supplied to the first and second traveling motors and so as to form a communication flow path providing communication between the first and second pumps, while the regeneration control unit can appropriately judge the propriety of the regeneration operation on the basis of whether or not the physical quantity to be the index of the driving state of the work actuator is within the allowable range corresponding to the target work operation amount, regardless of the communication between the first and second pumps.

It is preferable that the driving state detector is a speed detector that detects a target work motion speed which is a speed of the target work motion as the physical quantity to be the index of the driving state, and the regeneration control unit stores a speed allowable value that is preset in correspondence with the target work operation amount, the regeneration control unit being configured to make the regeneration valve and the regeneration release valve perform the regeneration release operation when the target work motion speed detected by the speed detector is equal to or less than the speed allowable value corresponding to the target work operation amount and configured to make the regeneration valve and the regeneration release valve perform the regeneration operation when the target work motion speed detected by the speed detector is greater than the speed allowable value. The thus configured regeneration control unit can reliably judge driving state of the work actuator that is driven to make the work actuator perform the target work motion on the basis of the target work motion speed and thereby make appropriate judgment on the propriety of the regeneration operation.

In this mode, it is preferable that the regeneration control unit is configured to set a larger speed allowable value as the flow rate of hydraulic fluid discharged by the first pump is larger as the speed allowable value corresponding to the target work operation amount. Since the target work motion speed is increased with an increase in the flow rate of the hydraulic fluid supplied to the work actuator increases, the regeneration control unit can appropriately judge the driving state of the work actuator by use of the speed allowable value which is increased with an increase in the flow rate of hydraulic fluid discharged from the first pump increases as a reference.

The driving state detector, alternatively, may be a thrust detector that detects an actuator thrust that is a thrust of the work actuator as the physical quantity to be the index of the driving state. In this case, preferably, the regeneration control unit stores a thrust allowable value that is preset in correspondence with the target work operation amount, the regeneration control unit being configured to make the regeneration valve and the regeneration release valve perform the regeneration release operation when the actuator thrust detected by the driving state detector is equal to or greater than the thrust allowable value corresponding to the target work operation amount and configured to make the regeneration valve and the regeneration release valve perform the regeneration operation when the actuator thrust detected by the driving state detector is less than the thrust allowable value corresponding to the target work operation amount. The thus configured regeneration control unit can reliably judge the driving state of the work actuator in which the thrust is generated, on the basis of the actuator thrust, and thereby make appropriate judgment on the propriety of the regeneration operation.

The invention claimed is:

1. A hydraulic control apparatus to be provided in a work machine that includes a first traveling body and a second traveling body, which are provided on the left and right and capable of performing respective traveling motions, and a work attachment capable of performing a work motion, the hydraulic control apparatus comprising:

a first pump that discharges hydraulic fluid;

a second pump that is separately provided from the first pump and discharges hydraulic fluid;

a first traveling motor that is driven by supply of hydraulic fluid to make the first traveling body perform the traveling motion;

a second traveling motor that is driven by supply of hydraulic fluid to make the second traveling body perform the traveling motion;

a work actuator that is driven by supply of hydraulic fluid to make the work attachment perform a target work motion included in the work motion;

a flow-path selector valve capable of making a flow-path switching motion for switching a flow path of hydraulic fluid discharged by the first pump and the second pump, the flow-path switching motion being a motion of being shifted between a first position for forming a flow path for allowing hydraulic fluid discharged from the first pump to be supplied to the first traveling motor and allowing hydraulic fluid discharged from the second pump to be supplied to the second traveling motor and the work actuator without being supplied to the first traveling motor and a second position for forming a first flow path for allowing hydraulic fluid discharged from the first pump to be supplied to the work actuator and a second flow path for allowing hydraulic fluid discharged from the second pump to be supplied to the first traveling motor and the second traveling motor and forming a communication flow path providing communication between the first flow path and the second flow path, the communication flow path having an opening area variable by the flow-path switching motion;

a regeneration valve provided in a regeneration flow path for merging discharge hydraulic fluid that is discharged from the work actuator making the work actuator perform the target work motion into supply hydraulic fluid that is to be supplied to the work actuator, the regeneration valve being shiftable between an opening state of opening the regeneration flow path and a closing state of blocking the regeneration flow path;

a regeneration release valve provided in a return flow path allowing the discharge hydraulic fluid to be returned to a tank without merging into the supply hydraulic fluid, the regeneration release valve being shiftable between an opening state of opening the return flow path and a closing state of blocking the return flow path;

a driving state detector that detects a physical quantity which is an index of a driving state of the work actuator and varied with a variation in the load of the work actuator;

a flow-path switching control unit that makes the flow-path selector valve perform the flow-path switching motion, the flow-path switching control unit configured to shift the flow-path selector valve to the first position in a single operation state where only one of a target work operation that is an operation for making the work attachment perform the target work motion and a traveling operation that is an operation for making the first traveling motor and the second traveling motor perform the respective traveling motions and configured to shift the flow-path selector valve to the second position in a combined operation state where the target work operation and the traveling operation are simultaneously performed;

a regeneration control unit that shifts the regeneration valve and the regeneration release valve between a state where the regeneration valve is shifted to the opening state and the regeneration release valve is shifted to the closing state to thereby perform regeneration operation of allowing the discharge hydraulic fluid to be merged into the supply hydraulic fluid and a state where the regeneration valve is shifted to the closing state and the regeneration release valve is shifted to the opening state to perform a generation release operation of preventing the discharge hydraulic fluid from being merged into the supply hydraulic fluid; and a pump pressure detector that detects a second pump pressure, which is a pressure of hydraulic fluid discharged by the second pump, wherein:

the regeneration control unit is configured to make the regeneration valve and the regeneration release valve perform the regeneration operation when the second pump pressure detected by the pump pressure detector is less than a preset regeneration allowable pump pressure in the single operation state and configured to make the regeneration valve and the regeneration release valve perform the regeneration release operation when the second pump pressure detected by the pump pressure detector is equal to or greater than the regeneration allowable pump pressure in the single operation state; and the regeneration control unit stores an allowable range of the physical quantity detected by the driving state detector, the allowable range being set in correspondence with a target work operation amount which is a magnitude of the target work operation, the regeneration control unit being configured to make the regeneration valve and the regeneration release valve perform the regeneration operation when the physical quantity detected by the driving state detector is within the allowable range corresponding to the target work operation amount in the combined operation state and configured to make the regeneration valve and the regeneration release valve perform the regeneration release operation when the physical quantity detected by the driving state detector is deviated from the allowable range corresponding to the target work operation amount.

2. The hydraulic control apparatus according to claim 1, wherein the driving state detector is a speed detector that detects a target work motion speed which is a speed of the target work motion as the physical quantity to be the index of the driving state, and the regeneration control unit stores a speed allowable value that is preset in correspondence with the target work operation amount, the regeneration control unit being configured to make the regeneration valve and the regeneration release valve perform the regeneration release operation when the target work motion speed detected by the speed detector is equal to or less than the speed allowable value corresponding to the target work operation amount and configured to make the regeneration valve and the regeneration release valve perform the regeneration operation when the target work motion speed detected by the speed detector is greater than the speed allowable value.

3. The hydraulic control apparatus according to claim 2, wherein the regeneration control unit sets a larger speed allowable value as the flow rate of hydraulic fluid discharged by the first pump is larger, as the speed allowable value corresponding to the target work operation amount.

4. The hydraulic control apparatus according to claim 1, wherein the driving state detector detects an actuator thrust that is a thrust of the work actuator, as the physical quantity to be the index of the driving state, and the regeneration control unit stores a thrust allowable value that is preset in correspondence with the target work operation amount, the regeneration control unit being configured to make the regeneration valve and the regeneration release valve perform the regeneration release operation when the actuator thrust detected by the driving state detector is equal to or greater than the thrust allowable value corresponding to the target work operation amount and configured to make the regeneration valve and the regeneration release valve perform the regeneration operation when the actuator thrust detected by the driving state detector is less than the thrust allowable value corresponding to the target work operation amount.

* * * * *